US006893302B1

(12) United States Patent
Clausen et al.

(10) Patent No.: US 6,893,302 B1
(45) Date of Patent: May 17, 2005

(54) SELECTABLE AIR PROPELLER DRIVE SYSTEM

(75) Inventors: Dean Clausen, Fort Myers Beach, FL (US); Joseph Varga, Woodbridge (CA)

(73) Assignee: Husky Airboats Ltd., (CA)

( * ) Notice: Subject to any disclaimer, the term of this patent is extended or adjusted under 35 U.S.C. 154(b) by 0 days.

(21) Appl. No.: 10/834,846

(22) Filed: Apr. 30, 2004

(51) Int. Cl.[7] ..... B63H 7/00
(52) U.S. Cl. ..... 440/37; 440/75
(58) Field of Search ..... 440/37, 75

(56) References Cited

U.S. PATENT DOCUMENTS

| | | | | |
|---|---|---|---|---|
| 2,341,911 A | * | 2/1944 | Drexler et al. | 440/37 |
| 4,015,555 A | * | 4/1977 | Tinkham | 440/37 |
| 4,027,553 A | | 6/1977 | Eichinger et al. | |
| 4,962,718 A | | 10/1990 | Gornstein et al. | |
| 5,151,059 A | * | 9/1992 | Higby | 440/75 |
| 5,529,520 A | | 6/1996 | Iwashita et al. | |
| 5,558,498 A | | 9/1996 | Ogino | |
| 5,643,025 A | | 7/1997 | Suzuki | |
| 5,724,867 A | | 3/1998 | Jordan | |
| 5,839,926 A | | 11/1998 | Kaye | |
| 5,890,938 A | | 4/1999 | Eick et al. | |
| 6,053,782 A | | 4/2000 | Jordan | |
| 6,299,495 B1 | | 10/2001 | Jordan | |
| 6,478,641 B2 | | 11/2002 | Jordan | |
| 6,540,570 B1 | | 4/2003 | Eakin | |

* cited by examiner

*Primary Examiner*—Jesus D. Sotelo
(74) *Attorney, Agent, or Firm*—Katten Muchin Zavis Rosenman

(57) ABSTRACT

An airboat and selectable drive system for an airboat are described. The airboat may be configured for mounting an engine either high or low in the hull of an airboat. The selectable drive system is connected to the engine. The selectable drive system includes a transmission interconnected to an air propeller drive. A clutch has three positions to include forward, neutral, and reverse. The air propeller drive rotates the air propeller in one of two directions based upon the selected position of the clutch. The drive system has the capability to rotate air propellers at different speeds. The reverse speed of rotation of the air propellers may be higher or lower than the forward speed of rotation. The modular design and simplified drive system is easier to assemble and align for both configurations.

38 Claims, 14 Drawing Sheets

SELECTABLE AIR PROPELLER DRIVE SYSTEM

BACKGROUND OF INVENTION

1. Field of the Invention

The present invention is directed to a drive system, and more particularly to a selectable drive system for controlling the direction of an air propeller that drives an airboat.

2. Background Information

Drive systems for propelling airboats are known in the art. For example, U.S. Pat. No. 6,540,570 B1 issued to Eakin on Apr. 1, 2003. This reference illustrates an airboat where the engine is mounted high above the hull. A transmission is driven by the engine through a belt connection located between a drive shaft and a sprocket. A number of gears transmit power from the engine and rotate the air propellers.

Other examples of prior art airboat drive systems include:

(a) U.S. Pat. No. 5,839,926 issued to K-Way on Nov. 24, 1998, (b) U.S. Pat. No. 6,053,782 issued to Bell on Apr. 25, 2000, (c) U.S. Pat. No. 6,478,641 issued to Jordan on Nov. 12, 2002, (d) U.S. Pat. No. 5,724,867 issued to Jordan on Mar. 10, 1998, and (e) U.S. Pat. No. 6,299,485 issued to Jordan on Oct. 9, 2001.

All of these references illustrate an engine mounted high above the hull of an airboat. A transmission is driven by a direct connection to the engine through a drive shaft. A number of gears are provided to operate a pair of output drive shafts. One of the output drive shafts is hollow and surrounds the other solid drive shaft to rotate the air propellers. The transmissions are directly driven by the engine.

Another example of a prior art drive system is shown in the Husky™ Nattiq™ airboat (www.huskyairboats.com). This airboat has the engine mounted low in the hull of an airboat. The existing drive system is an elongated belt extending from a pulley mounted on an end of a drive shaft of an engine to another pulley mounted on a air propeller drive shaft.

However, there is a fundamental problem and limitation with the known prior art airboat drive systems. The transmissions are not selectable and do not provide a reverse capability. As a result, the prior art drives fail to provide thrust for maneuverability and control of an airboat.

Therefore, there is a need for an improved drive system in an airboat that is selectable between a forward, neutral, and reverse direction when the engine is running.

SUMMARY OF INVENTION

The present invention has many advantages. Operating the selectable drive system in neutral prevents motion of the airboat when the engine is running. Operating the drive system in forward propels the airboat in a forward direction. Operating the drive system in reverse when the airboat is in forward motion provides an air break to slow the airboat speed. Operating the drive system in reverse further propels the airboat in a reverse direction. The modular design of the selectable drive system may be applied to the case where the engine is mounted high in the hull or when the engine is mounted low in the boat. When the engine is mounted high in the hull, the transmission and air propeller drive are secured together, or are mounted in close proximity by a supporting structure and interconnecting frame. When the engine is mounted low in the hull, the transmission and air propeller drive are separated by a distance and supported by an interconnecting frame. The modular design and simplified drive is easier to assemble and align.

In one broad aspect of the present invention, an airboat is provided. The airboat comprises a hull, an engine mounted in the hull, at least one air rudder, at least one air propeller, and a selectable drive system. The selectable drive system includes an air propeller drive, a transmission, and a clutch. The engine engaging the transmission providing in use operational power to the transmission. The transmission in use providing operational power to the air propeller drive. The at least one air propeller rotated, in use, by the air propeller drive. The clutch operable, in use, between a forward position and a reverse position. The clutch in the forward position directs rotation of the at least one air propeller in a first direction for moving the airboat in a forward direction and the clutch in the reverse position directions rotation of the at least one air propeller in a second opposite direction for moving the airboat in a reverse direction.

The airboat may further include a first differential drive. The first differential drive providing, in use, a first differential rotational speed to a first air propeller and a second differential rotational speed to a second air propeller in a second opposite direction.

The airboat may further include a second differential drive. The second differential drive providing, in use, a reverse rotational speed to a first air propeller when the clutch is in the reverse position, and the first differential drive providing, in use, a different forward rotational speed to a second air propeller when the clutch is in the forward position.

In an embodiment of the invention, the air propeller drive is a counter rotating air propeller drive for simultaneous counter rotation, in use, of a first air propeller in a first direction and a second air propeller in a second opposite direction.

In an embodiment of the invention, the counter rotating air propeller drive includes a first drive, a second drive, and a third drive. The first air propeller rotated, in use, by the second drive. The second air propeller rotated, in use, by the third drive. The first drive rotating, in use, the second drive in a first direction and the first drive simultaneously rotation, in use, the third drive in an opposite second direction.

In an embodiment of the invention, the second drive extends through the third drive.

In an embodiment of the invention, the first drive includes a first bevel gear and a first housing member. The first bevel gear mounted in the first housing. The first bevel gear rotated, in use, by transmission members.

In an embodiment of the invention, the second drive includes a second bevel gear, a second housing member, and an air propeller drive shaft. The second bevel gear mounted in the second housing. The second bevel gear having a mount for receiving an air propeller drive shaft. The second air propeller rotated, in use, by the air propeller drive shaft. Teeth on the second bevel gear engaging teeth on the first bevel gar for rotation, in use, of the second bevel gear by the first bevel gear. The second housing mounted in the counter rotation air propeller drive about a horizontal axis.

In an embodiment of the invention, the third drive includes a third bevel gear, and a third housing member. The third bevel gear mounted in the third housing member. The third bevel gear for rotating, in use, the first air propeller. Teeth on the third bevel gear engaging teeth on the first bevel gear for rotation, in use, of the third bevel gear by the first bevel gear, and the third housing mounted in the counter rotating air propeller drive about the horizontal axis.

In an embodiment of the invention, the transmission includes a fourth drive and a fifth drive. The fifth drive rotating, in use, the fourth drive.

In an embodiment of the invention, the transmission includes a fourth drive, and a fifth drive for rotating, in use, the fourth drive and the fourth drive rotating, in use, the first drive.

In an embodiment of the invention, the fourth drive includes a fourth bevel gear and a fourth housing member. The fourth bevel gear mounted in said fourth housing member. The fourth bevel gear and the first bevel gear connected by an interconnecting drive shaft.

In an embodiment of the invention, the fifth drive includes a fifth bevel gear and a sixth bevel gear. The fifth bevel gear for rotating, in use, the fourth bevel gear in a first direction when the clutch is in the forward position and the sixth bevel gear for rotating, in use, the fourth bevel gear in a second opposite direction when the clutch is in the reverse position.

In an embodiment of the invention, teeth on the fifth bevel gear engage teeth on the fourth bevel gear, and teeth on the sixth bevel gear engage the teeth on the fourth bevel gear.

In an embodiment of the invention, the airboat includes a first friction cone clutch. The first friction cone clutch having a neutral position and an engaging position providing, in use, the operational power to the air propeller drive in a first forward direction.

In an embodiment of the invention, the airboat includes a second friction cone clutch. The second friction cone clutch having a neutral position and an engaging position providing, in use, the operational power to the air propeller drive in a second reverse direction.

In an embodiment of the invention, the airboat includes a fourth bevel gear, a fifth bevel gear, a sixth bevel gear, and a clutch member. The fourth bevel gear providing, in use, the operational power to the air propeller drive. The fifth bevel gear engaging the fourth bevel gear. The sixth bevel gear engaging the fourth bevel gear. The first friction cone clutch intermediate a driven shaft and the fifth bevel gear and the second friction cone clutch intermediate the driven shaft and the sixth bevel gear.

In an embodiment of the invention, the airboat includes a fist clutch coupler, and a second clutch coupler. The first clutch coupler intermediate the fifth bevel gear and the clutch member, and the second clutch coupler intermediate the sixth bevel gear and the clutch member.

In an embodiment of the invention, wherein the first friction cone clutch is a first external cone surface on the clutch member and a first internal cone surface on the first clutch coupler and the second friction cone clutch is a second external cone surface on the clutch member and a second internal cone surface on the second clutch coupler.

In another broad aspect of the present invention, a selectable drive system for an airboat is provided. The selectable drive system comprises an air propeller drive, a transmission, and a clutch. The transmission having an interface for connection to an airboat engine. The transmission, in use, providing operational power to the air propeller drive. The air propeller drive for rotating, in use, at least one air propeller. The clutch operable, in use, between a forward position and a reverse position. The clutch in the forward position directs rotation of the at least one air propeller in a first direction for moving the airboat in a forward direction and the clutch in the reverse position directs rotation of the at least on air propeller in a second opposite direction for moving the airboat in a reverse direction.

The selectable drive system may further include a first differential drive. The first differential drive providing, in use, a first differential rotational speed to a first air propeller and a second differential rotational speed to a second air propeller in a second opposite direction.

The selectable drive system may further include a second differential drive providing, in use, a reverse rotational speed to a first air propeller when the clutch is in the reverse position, and the first differential drive providing, in use, a different forward rotational speed to a second air propeller when the clutch is in the forward position.

In an embodiment of the selectable drive system, the air propeller drive is a counter rotating air propeller drive for simultaneous counter rotation, in use, of a first air propeller in a first direction and a second air propeller in a second opposite direction.

In an embodiment of the selectable drive system, the counter rotating air propeller drive includes a first drive, a second drive, and a third drive. The first air propeller rotated, in use, by the second drive. The second air propeller rotated, in use, by the third drive. The first drive rotating, in use, the second drive in a first direction and the first drive simultaneously rotating, in use, the third drive in an opposite second direction.

In an embodiment of the selectable drive system, the second drive extends through the third drive.

In an embodiment of the selectable drive system, the first drive includes a first bevel gear, and a first housing member. The first bevel gear mounted in the first housing. The first bevel gear rotated, in use, by transmission members.

In an embodiment of the selectable drive system, the second drive includes a second bevel gear, second housing member, and an air propeller drive shaft. The second bevel gear mounted in the second housing, the second bevel gear having a mount for receiving an air propeller drive shaft. The second air propeller rotated, in use, by the air propeller drive shaft. Teeth on the second bevel gear engaging teeth on the first bevel gear for rotation, in use, of the second bevel gear by the first bevel gar, and the second housing mounted in the counter rotating air propeller drive about a horizontal axis.

In an embodiment of the selectable drive system, the third drive includes a third bevel gear, a third housing member, and an air propeller mount. The third bevel gear mounted in the third housing member. The third bevel gear for rotating, in use, the first air propeller. Teeth on the third bevel gear engaging teeth on the first bevel gear for rotation, in use, of the third bevel gear by the first bevel gear, and the third housing mounted in the counter rotating air propeller drive about the horizontal axis.

In an embodiment of the selectable drive system, the transmission includes a fourth drive, and a fifth drive. The fifth drive rotating, in use, the fourth drive.

In an embodiment of the selectable drive system, the transmission includes a fourth drive, and a fifth drive. The fifth drive for rotating, in use, the fourth drive and the fourth drive rotating, in use, the first drive.

In an embodiment of the selectable drive system, the fourth drive includes a fourth bevel gear, and a fourth housing member. The fourth bevel gear mounted in the fourth housing member, the fourth bevel gear and the first bevel gear connected by an interconnecting drive shaft.

In an embodiment of the selectable drive system, the fifth drive includes a fifth bevel gear, and a sixth bevel gear. The fifth bevel gear for rotating, in use, the fourth bevel gear in a first direction when the clutch is in the forward position, and the sixth bevel gear for rotating, in use, the fourth bevel gear in a second opposite direction when the clutch is in the reverse position.

In an embodiment of the selectable drive system, teeth on the fifth bevel gear engage teeth on the fourth bevel gear, and teeth on the sixth bevel gear engage the teeth on the fourth bevel gear.

In an embodiment of the selectable drive system, further including a friction cone clutch. The first friction cone clutch having a neutral position and an engaging position providing, in sue, the operational power to the air propeller drive in a first forward direction.

In an embodiment of the selectable drive system, further including a second friction cone clutch. The second friction cone clutch having a neutral position and an engaging position providing, in use, the operational power to the air propeller drive in a second reverse direction.

In an embodiment of the selectable drive system, further including a fourth bevel gear, a fifth bevel gear, a sixth bevel gear, and a clutch member. The fourth bevel gear providing, in use, the operational power to the air propeller drive. The fifth bevel gear engaging the fourth bevel gear. The sixth bevel gear engaging the fourth bevel gear. The first friction cone clutch intermediate a driven shaft and the fifth bevel gear, and the second friction cone clutch intermediate the driven shaft and the sixth bevel gear.

In an embodiment of the selectable drive system, further including a first clutch coupler, and a second clutch coupler. The first clutch coupler intermediate the fifth bevel gear and the clutch member, and the second clutch coupler intermediate the sixth bevel gear and the clutch member.

In an embodiment of the selectable drive system, the first friction cone clutch is a first external cone surface on the clutch member and a fist internal cone surface on the first clutch coupler, and the second friction cone clutch is a second external cone surface on the clutch member and a second internal cone surface on the second clutch coupler.

BRIEF DESCRIPTION OF DRAWINGS

Exemplary embodiments of the present invention will now be described with reference to the accompanying drawings, in which.

DETAILED DESCRIPTION

Figure 1:
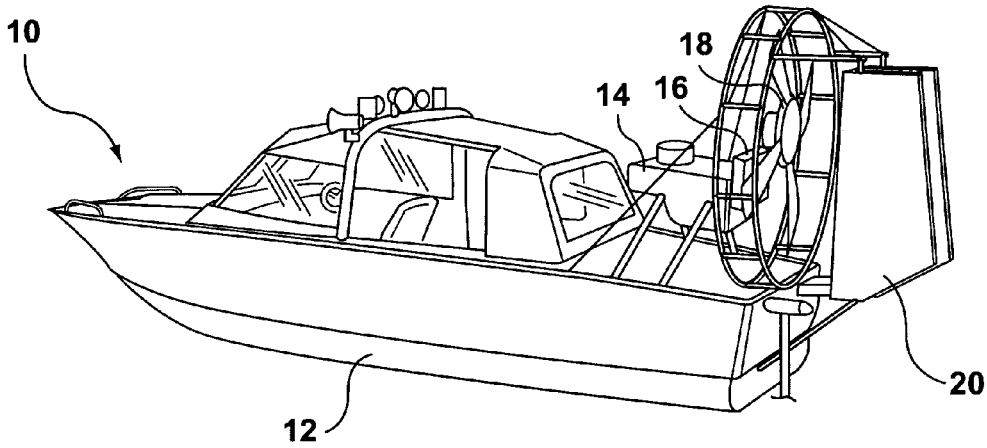
FIG. 1 is a diagrammatic perspective view of an airboat and a counter rotating air propeller drive system with the engine mounted high in the hull.

The present invention is described in accordance with an embodiment as illustrated with reference to FIG. 1. An airboat is generally indicated at 10. The airboat 10 is capable of operating on water, ice, and snow.

The airboat 10 includes a hull 12. An engine 14 is mounted high in the hull 12 of the airboat 10 by a supporting structure and frame. The engine 14 is connected through a drive shaft (not shown) to a selectable drive system 16 (schematic representation). The selectable drive system 16 includes a transmission 22 and counter rotating air propeller drive 26 (see FIG. 3). A pair of air propellers 18 are connected to the counter rotating drive and in operation, the air propellers rotate in opposite directions to provide the necessary thrust to maneuver the airboat 10. A pair of air rudders 20 are provided in order to maneuver the airboat 10 in operation by re-directing the flow of air to turn the airboat 10 either left or right.

Figure 2:
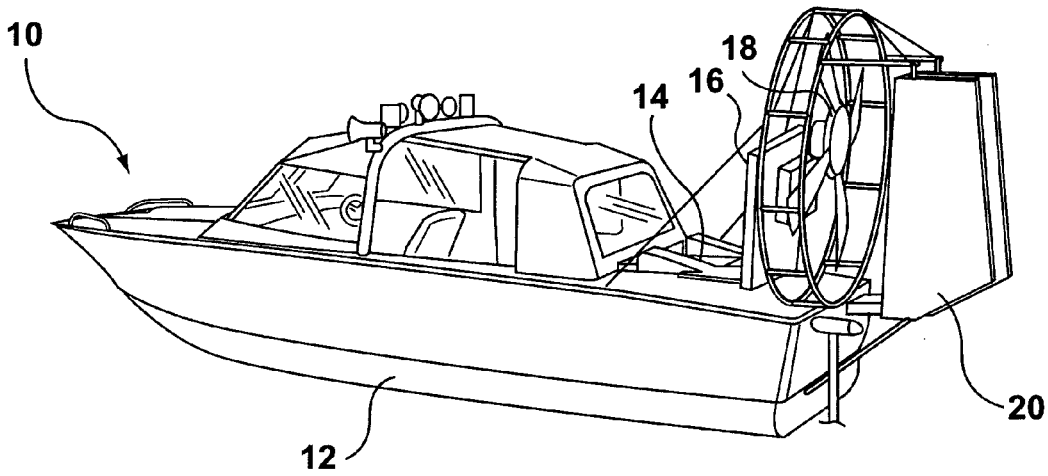
FIG. 2 is a diagrammatic perspective view of an airboat and a counter rotating air propeller drive system with the engine mounted low in the hull.

Another embodiment of the invention is illustrated in FIG. 2. Again, the airboat is generally indicated at 10. In this embodiment, the engine 14 is mounted low in the hull 12 of the airboat 10. The engine 14 is connected through a drive shaft (not shown) to a selectable drive system 16 (schematic representation). The selectable drive system 16 includes a transmission 22, interconnecting frame 24, and counter rotating air propeller drive 26 (see FIG. 4). A pair of air propellers 18 are connected to the counter rotating drive and in operation, the air propellers rotate in opposite directions to provide the necessary thrust to maneuver the airboat. A pair of air rudders 20 are provided in order to maneuver the airboat 10 in operation by re-directing the flow of air to turn the airboat 10 either left or right.

The transmission 22 may be selected to drive the air propellers 18 in a first direction and maneuver the airboat 10 in a forward direction. Alternatively, the transmission may be selected to drive the air propellers 18 in a second opposite direction. When the air propellers 18 are operating in the second opposite direction and if the airboat has a forward motion, the air propellers 18 act as an air break to slow the forward motion of the airboat 10. When the air propellers 18 are operating in the second opposite direction and if the airboat 10 is at rest, the air propellers act to thrust and maneuver the airboat 10 in a reverse direction.

Those skilled in the art will appreciate that alternatively the airboat 10 could be equipped with a single air rudder. Alternatively, the air propeller drive 16 could be for a single air propeller, or a multiple air propellers rotating in the same direction.

Figure 3:
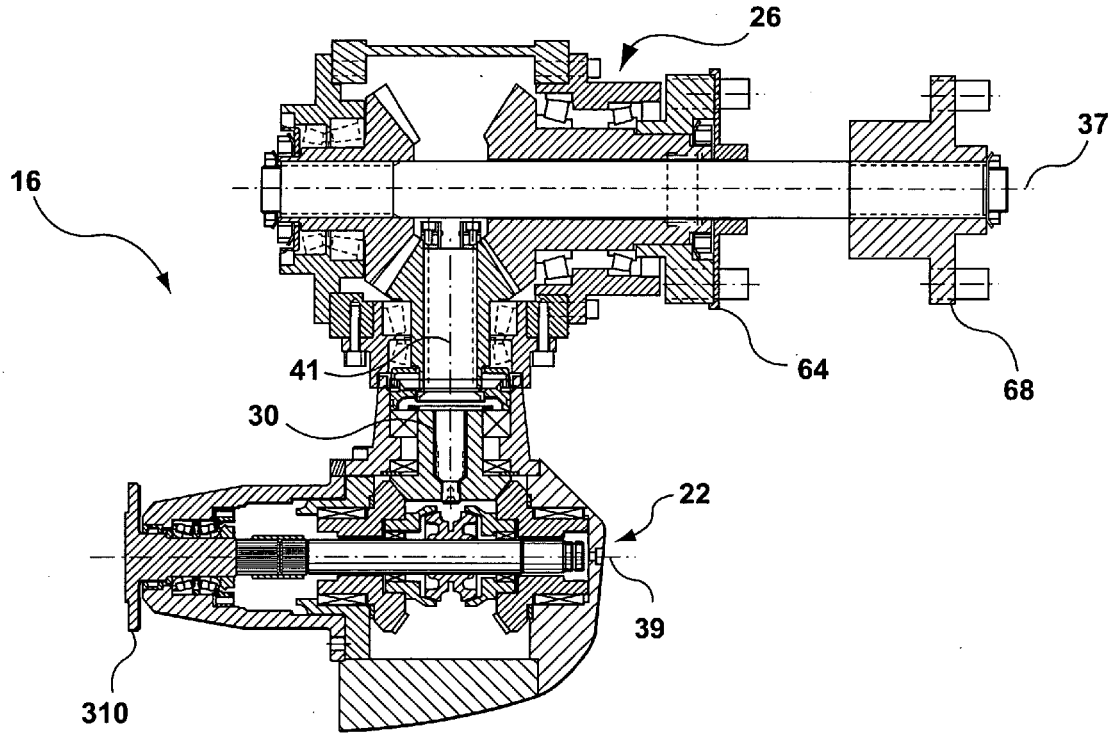
FIG. 3 is a diagrammatic cross sectional view of the drive system for an embodiment of the invention when the engine is mounted high in the hull.

Referring now to FIG. 3, the drive system 16 of the present invention for the embodiment where the engine is mounted high above the hull (FIG. 1) is further described.

The engine 14 (not shown) is connected to the transmission 22 through the input drive shaft 310. The transmission 22 is connected to the counter rotating air propeller drive 26 through a short interconnecting drive shaft 30 to transmit power from the transmission 22 to the counter rotating air propeller drive 26. The counter rotating air propeller drive 26 has a pair of air propeller hubs (64, 68) for mounting a first and second air propeller. For this embodiment, the counter rotating air propeller drive 26 is mounted and secured to the transmission 22 through a plurality of fasteners, for example, nuts and bolts. In addition, a supporting structure and frame (not shown) extends between the airboat 10 and the drive 16.

Figure 4:
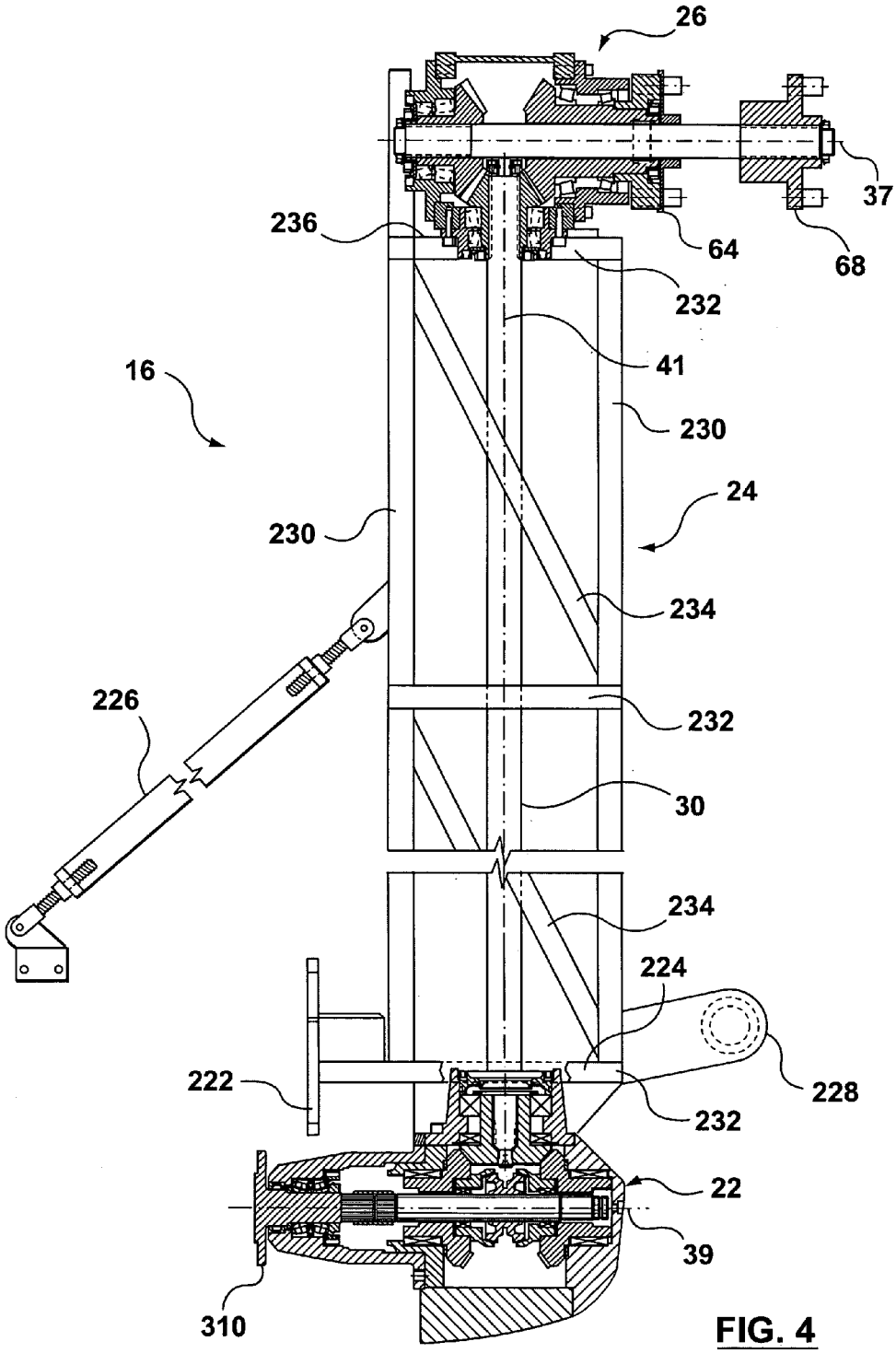
FIG. 4 is a diagrammatic cross sectional view of the drive system for an embodiment of the invention when the engine is mounted low in the hull.

Referring now to FIG. 4, the drive system 16 of the present invention where the engine is mounted low in the hull of the airboat 10 (FIG. 2) is further described. The engine 14 is connected to the transmission 22 through an input drive shaft 310. The transmission 22 is mounted low in the hull 12 of the airboat 10 in alignment with the engine 14. The counter rotating air propeller drive 26 is disposed above the transmission 22 by the interconnecting frame 24 at a suitable height to provide clearance for the air propellers 18 (not shown) with the hull of the airboat 10. The transmission 22 and counter rotating air propeller drive 26 are connected through an interconnecting drive shaft 30 to transmit power from the transmission 22 to the counter rotating air propeller drive 26. The transmission 22 and the counter rotating air propeller drive 26 are retained in operational alignment by the frame 24. The counter rotating air propeller drive 26 has a pair of air propeller hubs (64, 68) for mounting a first and second air propeller.

Referring now to both embodiments illustrated in FIG. 3 and FIG. 4, the transmission 22 is disposed about a first horizontal axis 39 and the counter rotating air propeller drive 26 is disposed about a second horizontal axis 37. The second horizontal axis 37 is above the first horizontal axis 39 and the second horizontal axis 37 is substantially parallel to the first horizontal axis 39. Preferably, the first horizontal 39 axis is in alignment with the engine. The second horizontal axis 37 may be in close proximity to the first horizontal axis 39 for the embodiment of FIG. 3, or the second horizontal axis 37 may be spaced away from the first horizontal axis 39 for the embodiment of FIG. 4.

The transmission 22 is connected to the counter rotating air propeller drive 26 about a third axis which is substantially perpendicular to the first axis and second axis. The third axis is intermediate the ends of the transmission 22 and the counter rotating air propeller drive 26. The interconnecting drive shaft 30 is disposed about the vertical axis 41.

Figure 5:
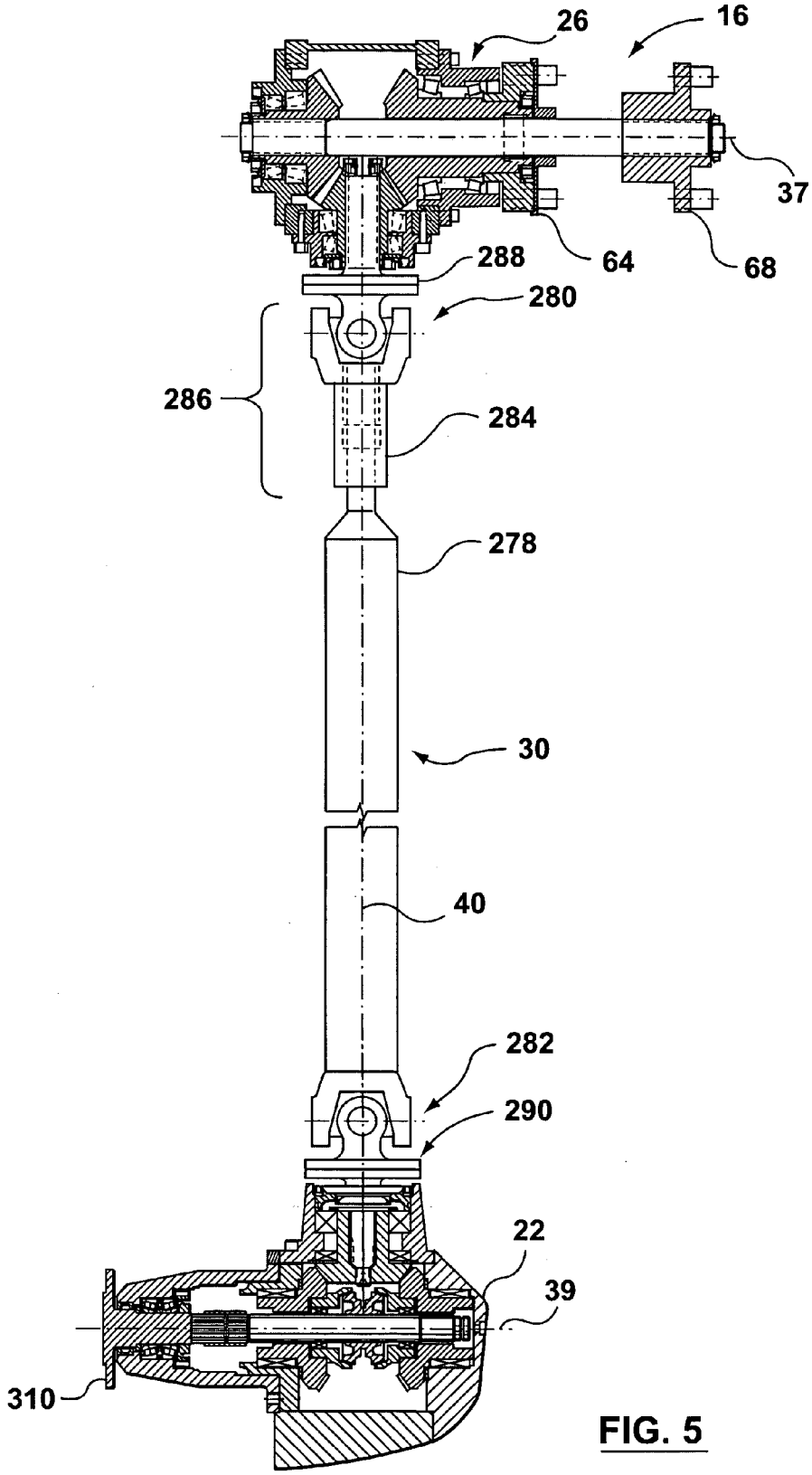
FIG. 5 is a diagrammatic cross sectional view of the drive system for an alternative embodiment of the invention when the engine is mounted low in the hull.

Referring now to FIG. 5, an alternative embodiment of the present invention is described with respect to the interconnecting drive shaft 30. In this embodiment, the interconnecting drive shaft 30 includes a primary drive interconnect 290, a primary universal joint 282, a primary drive section 278, a secondary drive section 286 and secondary drive interconnect 288.

The primary drive interconnect 290 has a splined shaft that interfaces to the fourth drive 32 in the transmission 22 through the mount 184 (see FIG. 12) and is retained with the fourth drive. A primary universal joint 282 connects the primary drive interconnect 290 to the primary drive section 278 at one end. This provides a first flexible joint between the transmission 22 and the counter rotating air propeller drive 26. The primary drive section 278 includes a splined shaft at another end to interface with a secondary drive section 286. The secondary drive section 286 has a complimentary splined mount for receiving the splined shaft. The spines cooperate to rotate both members while permitting a vertically sliding joint 284 between the primary drive section 278 and the secondary drive section 286.

The secondary drive section 286 is connected to the secondary drive interconnect 288 by a secondary universal joint 280. This provides a second flexible joint between the transmission 22 and the counter rotating air propeller drive 26. An end of the secondary drive interconnect 288 includes a splined shaft that interfaces to the mount 94 of the first drive 36 in the counter rotating air propeller drive 26 (see FIG. 9).

The alternative embodiment of the interconnecting drive shaft 30 provides two flexible joints and one vertically sliding joint when mounting the counter rotating air propeller drive 26 at differing vertical and horizontal alignments from the transmission 22 while providing rotation movement of the interconnecting drive shaft 30.

Figure 6:
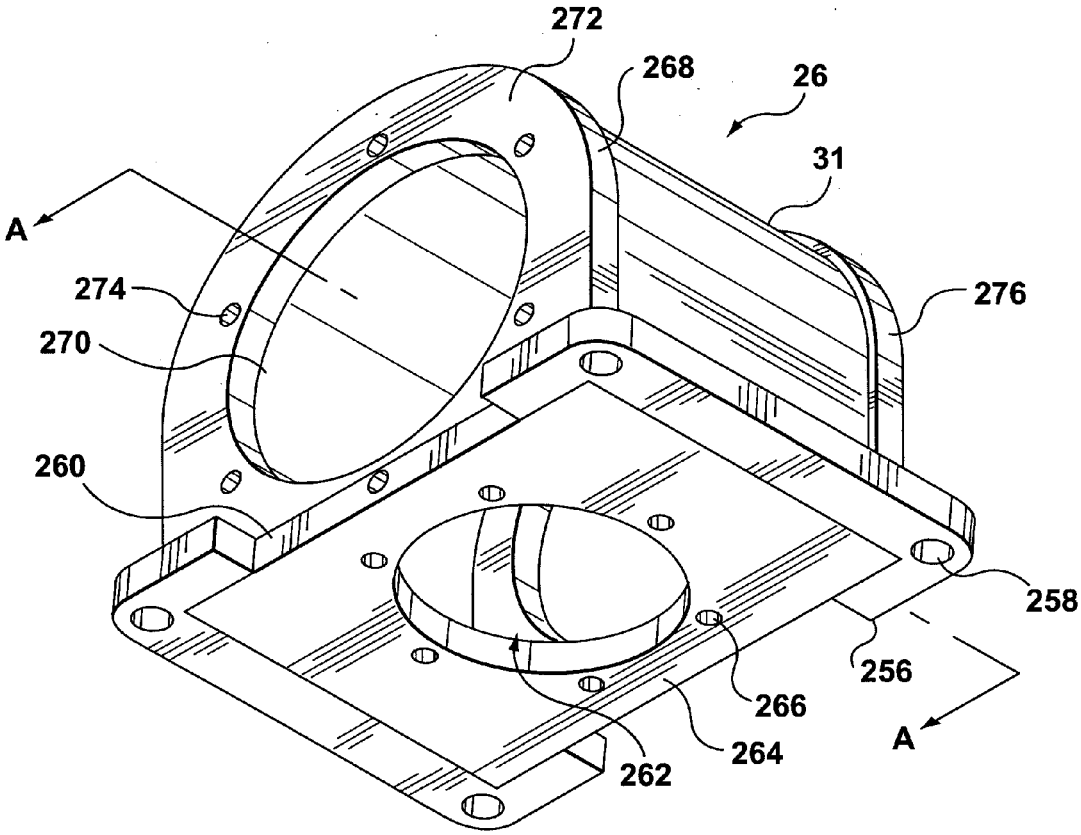
FIG. 6 is a diagrammatic perspective view of the counter rotating air propeller drive housing.

Referring now to FIG. 6, the central housing 31 of the counter rotating air propeller drive 26 is described. The central housing 31 includes a bottom member 260. The bottom member 260 has a mounting surface 264 and a central opening 262. The central opening 262 and surface 264 receive for mounting the first drive 36 (not shown). A plurality of threaded bores 266 are provided in the bottom member 260 for securing and sealing the first drive 36 to the bottom member 260 by a plurality of fasteners, for example bolts.

The central housing 31 also includes a front member 268. The front member 268 has a mounting surface 272 and a central opening 270. The central opening 270 and surface 272 receive for mounting the second drive 38 (not shown). A plurality of threaded bores 274 are provided in the front member 268 for securing and sealing the second drive 28 to the front member 268 by a plurality of fasteners, for example bolts.

The central housing 31 also includes a back member 276. The back member is substantially the same as the front member 268 (for example, the size of the central opening may be a different diameter, larger in the preferred embodiment). The back member has a mounting surface (not shown) and central opening (not shown). The third drive 40 is received for mounting by the surface and central opening of the back member 276. A plurality of threaded bores (not shown) are provided in the back member 276 for securing the third drive 40 to the back member 276 by a plurality of fasteners, for example bolts.

The central housing 31 also includes a frame mount member 256. The frame mount member 256 has a plurality of bores 258. The frame mount member 256 and bores 258 are for mounting and securing the central housing 31 in the interconnecting frame 24.

Figure 7:
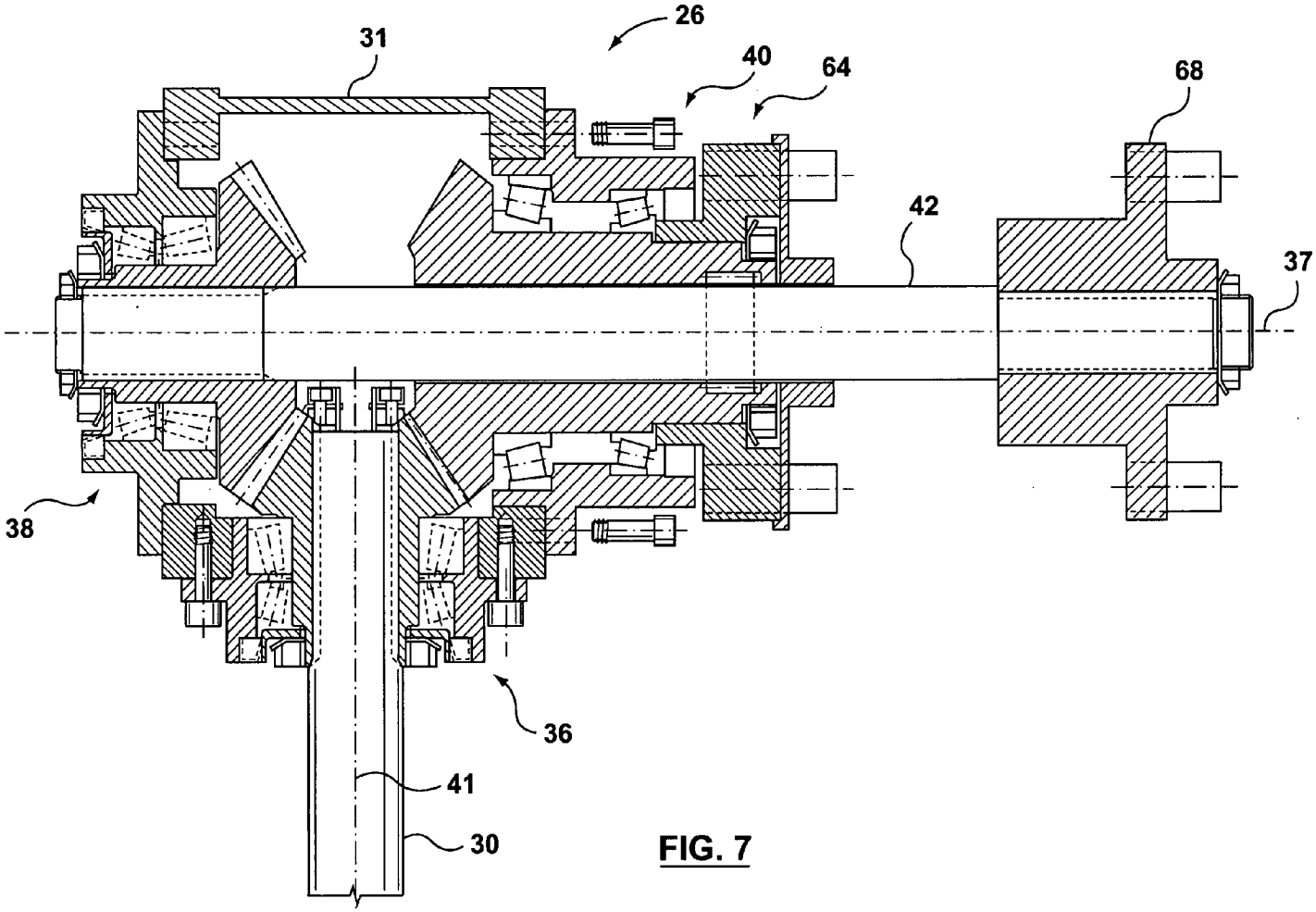
FIG. 7 is a diagrammatic cross sectional side view of the counter rotating air propeller drive illustrating the first drive, second drive, and third drive.

Referring now to FIG. 7, a cross sectional view of the counter rotating air propeller drive 26 is further described. A first drive, generally indicated at 36 is illustrated mounted in the first opening 262 of the bottom member 260 as previously described.

A second drive, generally indicated at 38 is illustrated mounted in the second opening 270 of the front member 268 as previously described. The second drive 38 is connected to an air propeller output drive shaft 42. Rotation of the second drive 38 causes rotation of the air propeller output drive shaft 42. A second air propeller hub 68 is mounted on an end of the air propeller output drive shaft 42 for connecting a second air propeller (not shown) to the drive 26.

A third drive, generally indicated at 40, is illustrated mounted in the third opening of the back member 276 as previously described. In the preferred embodiment, a first air propeller hub 64 is mounted directly to the third drive 40 for connecting a first air propeller (not shown) to the drive 40. Alternatively, a first air propeller may be mounted to the third drive 40 without an air propeller hub 64.

The central housing 31 supports and retains the first drive 36, the second drive 38, and the third drive 40 in operational relationship such that rotation of the first drive 36 rotates the second drive 38 in one direction and the first drive 36 also operates the third drive 40 in an opposite direction for driving the counter rotating air propellers. The second drive 38 and the third drive 40 are retained in axial alignment about a lengthwise horizontal axis 37 by the central housing 31. This alignment is obtained by a inner surface of the second opening 270 in the front member 272 engaging a complimentary sidewall inner surface of the second housing member 48, and a surface of the third opening (not shown) in the back member 276 engaging a complimentary sidewall surface of the third housing member 50. The first drive 36 is retained about a substantially perpendicular vertical axis 41. A inner surface of the first opening 262 in the bottom member 260 engages a complimentary sidewall surface of the first housing member 46 provides alignment of the first drive 36.

Figure 9:
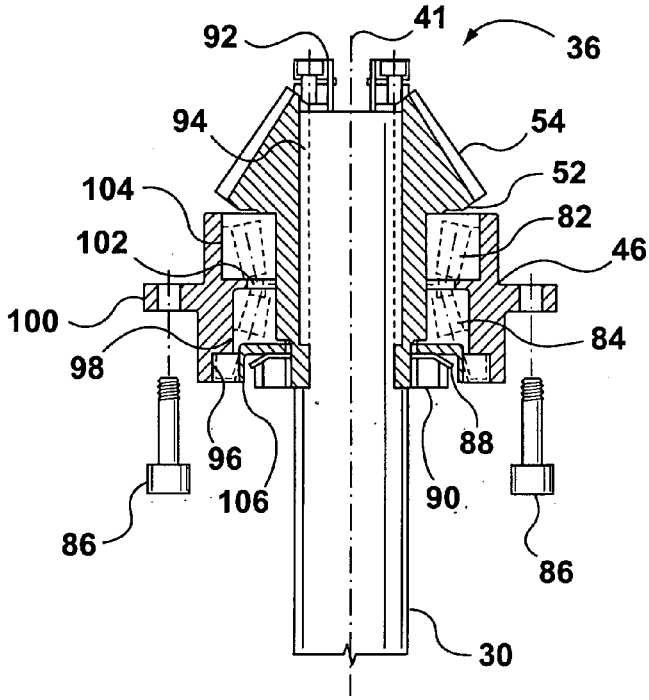
FIG. 9 is a diagrammatic cross sectional side view of the first drive.

Referring now to FIG. 9, the first drive 36 of the counter rotating air propeller drive 26 is further described.

The first drive 36 has a first housing member generally indicated as 46. The first housing member 46 is a separate member from the central housing 31. The first housing member 46 is formed by a main body with a central axial opening. A first cylindrical recess 96 is located in one end of the first housing member 46 for receiving a retainer 106. Optionally, a seal may be provided between the retainer 106 and the cylindrical recess 96. Persons skilled in the art understand a seal may be provided in other locations to keep a lubricant in the air propeller drive during operation. A second cylindrical recess 98 is formed in the first housing member 46 for receiving a bearing 84. A third cylindrical recess 104 is formed in the first housing member 46 for receiving a second bearing 82. A ledge 102 extends outwardly towards the central opening between the recesses (98, 104) separating the second cylindrical recess 98 and the third cylindrical recess 104. The ledge 102 provides support and a seat for the bearings (82, 84). The first housing member 46 has an outwardly extending flange 100 with a plurality of spaced openings for receiving fasteners. The outwardly extending flange 100 engages a surface 264 (see FIG. 4) for sealing engagement with the housing 31. A plurality of fasteners 86 secure and seal the first housing member 46 the central housing 31. Optionally, a seal ("O" ring or gasket) may be provided between the first housing member 46 and the central housing 31.

The first drive 36 also has a first bevel gear 52. The first bevel gear 52 has a plurality of teeth 54 for engaging teeth 58 of the second bevel gear 56 (not shown) and teeth 62 of the third bevel gear 60 (not shown). One end of the first bevel gear 52 includes a smaller diameter cylindrical threaded portion for receiving a nut 90. The other end of the first bevel gear 52 includes a surface for cooperating with a retainer 92.

A mount 94 is provided to engage the first bevel gear 52 with the interconnecting drive shaft 30. The mount 94 includes a toothed spline on one end of the interconnecting drive shaft 30 and a complimentary toothed spline on the inside surface of the central axial opening of the first bevel gear 52. The central axial opening of the first bevel gear 52 extends the length of the first bevel gear 52. Those skilled in the art will appreciate the mount 94 is not limited to toothed splines. Alternatively for example, a pair of slots and key could be used in the mount 94. The mount 94 provides rotation of the first bevel gear 52 with the interconnecting drive shaft 30 in operation.

The first bevel gear 52 is secured to the interconnecting drive shaft 30 by the retainer 92 and a shoulder on an end of the interconnecting drive shaft 30. While the retainer 92 is illustrated as a member with fasteners located on an end of the interconnecting drive shaft 30, other retainers may be applied. For example, an end of the interconnecting drive shaft 30 may be threaded to receive a nut for securing the first bevel gear 52 to the interconnecting drive shaft 30.

The first bevel gear 52 and the first housing member 46 are assembled to form the first drive 36. The bearing 82 is placed, or pressed, into the cylindrical recess 104 until it bottoms out and seats on a surface of the flange 102. The other bearing 84 is placed, or pressed, into the cylindrical recess 98 until it bottoms out and seats on an opposite surface of the flange 102. A cylindrical shaft of the first bevel gear 52 is inserted into the openings of the bearings (82, 84) until a ledge of the bevel gear 52 contacts a surface of the bearing 82. This locates the first bevel gear 52 in the central opening of the first housing member 46. The retainer 106 is placed over the threaded cylindrical section on the first bevel gear 52. The retainer 106 contacts a surface of the bearing 84. A nut 90 is placed on the threaded cylindrical section and tightened to retain the assembly in the first housing member 36. A lock washer 88 keeps the nut tight.

Figure 8:
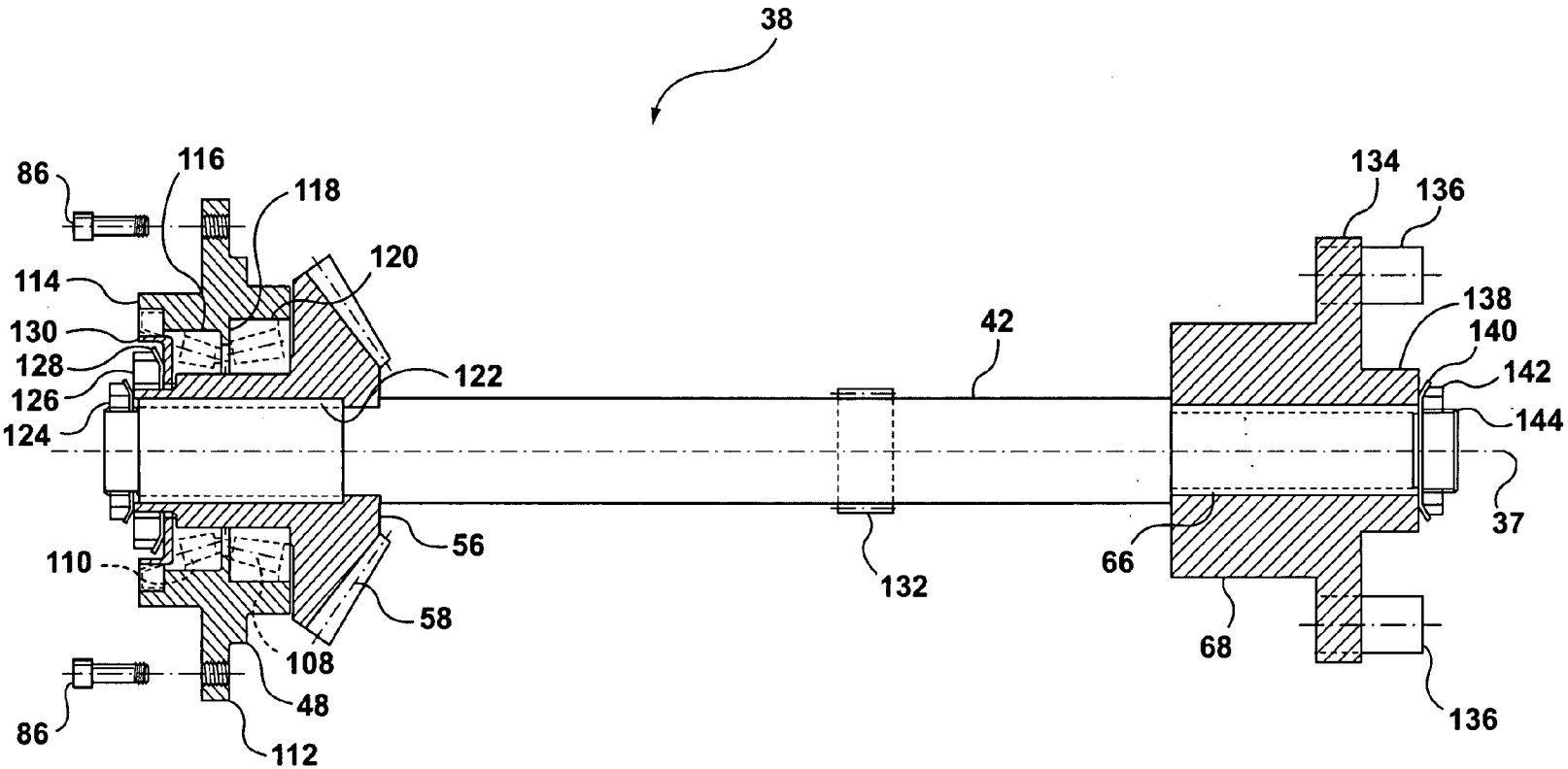
FIG. 8 is a diagrammatic cross sectional side view of the second drive.

Referring now to FIG. 8, the second drive 38 of the counter rotating air propeller drive 26 is further described.

The second drive 38 has a second housing member generally indicated as 48. The second housing member 48 is separate from the central housing 31. The second housing member 48 is formed by a main body with a central opening. A first cylindrical recess 114 is located in one end of the second housing member 48 for receiving a retainer 130. Optionally, a seal may be provided between the retainer 130 and the cylindrical recess 114. Persons skilled in the art understand a seal may be provided in other locations to keep a lubricant in the air propeller drive during operation. A second cylindrical recess 116 is formed in the second housing member 48 for receiving a bearing 110. A third cylindrical recess 120 is formed in the second housing member 48 for receiving a second bearing 108. A ledge 118 extends outwardly towards the central axial opening of the second housing member 48 separating the second cylindrical recess 116 from the third cylindrical recess 120. Opposite sides of the ledge 118 provide support and a seat for the bearings (110, 108). The second housing member 48 has an outwardly extending flange 112 with a plurality of spaced openings for receiving fasteners. The outwardly extending flange 112 engages a surface 272 (see FIG. 7) for sealing engagement. A plurality of fasteners 86 secure and seal the second housing member 48 and the housing 31. Optionally, a seal may be provided between the second housing member 48 and the housing 31 such as an "O" ring or gasket.

The second drive 38 also has a second bevel gear 56. The second bevel gear 56 has a plurality of teeth 58 for engaging teeth of the first bevel gear 52 (not shown). One cylindrical end of the second bevel gear 56 includes threads for receiving a nut 126.

A mount 122 is provided to engage the second bevel gear 56 with the air propeller drive shaft 42. The mount 122 includes a toothed spline on one end of the air propeller drive shaft 42 and a complimentary toothed spline on the inside surface of the central axial opening of the second bevel gear 56. The central axial opening extends the length of the second bevel gear 56. Those skilled in the art will appreciate the mount 122 is not limited to toothed splines. Alternatively for example, a key could be used in the mount 122. The mount 122 provides rotation of the second bevel gear 56 with the air propeller drive shaft 42 in operation.

The second bevel gear 56 is secured to the air propeller drive shaft 42 by the retainer 124 (illustrated as a nut and lock washer) and a shoulder on another end of the air propeller drive shaft 42.

The second bevel gear 56 and the second housing member 48 are assembled to form the second drive 38. The bearing 108 is placed, or pressed, into the third cylindrical recess 120 until it bottoms out and seats on a surface of the ledge 118. The other bearing 110 is placed, or pressed, into the cylindrical recess 116 until it bottoms out and seats on an opposite surface of the ledge 118. A cylindrical shaft of the second bevel gear 56 is inserted into the central opening of the bearings (108, 110) until a ledge of the second bevel gear 56 contacts a surface of the bearing 108. This locates the second bevel gear 56 in the central opening of the second housing member 48. The retainer 130 is placed over a cylindrical threaded section of smaller diameter on the second bevel gear 56. The retainer 130 contacts a surface of the bearing 110. A nut 126 is placed on the treaded section and tightened to retain the assembly in the second housing member 48. A lock washer 128 keeps the nut tight.

A bearing 132 is located intermediate the ends and on an outside surface of the air propeller drive shaft 42. The bearing 132 provides support and permits rotational movement between the air propeller drive shaft 42 and the third drive 40 (not shown).

The air propeller shaft 42 includes a mount 66 for receiving a second air propeller hub 68. The mount 66 includes a toothed spline on one end of the air propeller shaft 42 and a complimentary toothed spline on an inside surface of a central axial opening in the second air propeller hub 68. The mount 66 provides rotation of the second air propeller hub 68 with the air propeller shaft 42.

An end of the air propeller shaft 42 includes a threaded end 144. The air propeller hub 68 is secured to the air propeller shaft 42 by the nut 142 and a shoulder on the air propeller shaft 42. A lock washer 140 keeps the nut tight. The air propeller shaft 42 includes an outwardly extending flange 134 and a central hub 138. An air propeller is centered and mounted over the central hub and secured to the flange 134 by a plurality of fasteners 136, for example bolts.

Figure 10:
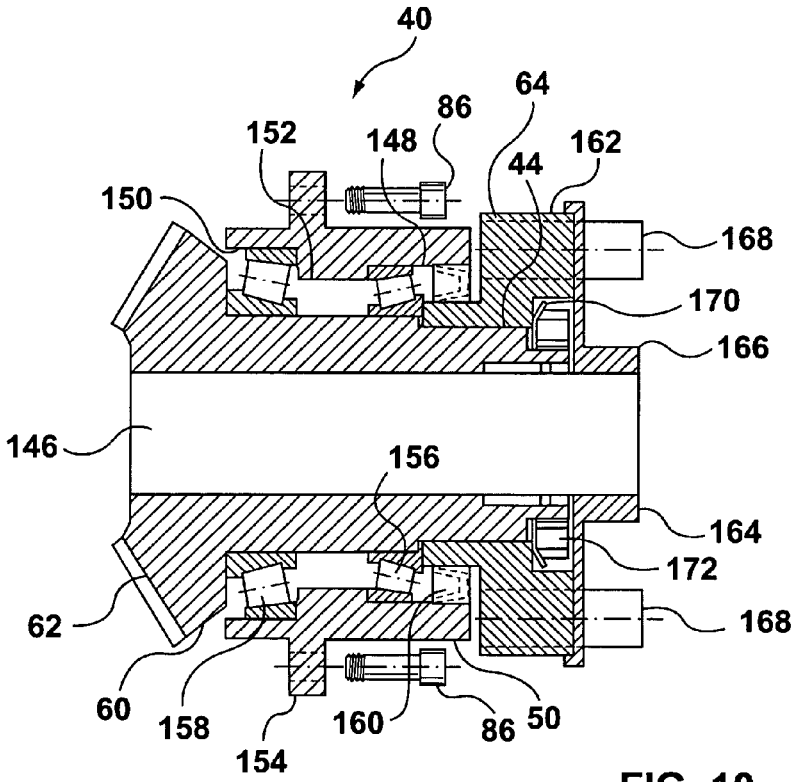
FIG. 10 is a diagrammatic cross sectional side view of the third drive.

Referring now to FIG. 10, the third drive 40 of the counter rotating air propeller drive 26 is further described.

The third drive 40 has a third housing member 50 and a third bevel gear 60. The third housing member 50 is separate from the central housing 31. The third bevel gear 60 has teeth 62 for engaging complimentary teeth 54 on the first bevel gear 52 (see FIG. 5). A central axial opening 146 extends lengthwise through the third bevel gear 60. The air propeller output drive shaft 42 extends through the central axial opening 146 (see FIG. 4). The bearing 132 engages an inner surface of the central opening 146 to support the air propeller output drive shaft 42. The third bevel gear 60 has a substantially cylindrical section. A first diameter portion receives the bearings (156, 158). A second smaller diameter portion includes the mount 44 for mounting the air propeller hub 64. Alternatively, an air propeller (not shown) may be mounted directly to the mount 44. In either embodiment, the air propeller is mounted to the third drive 40 by a drive shaftless connection. A third and smallest diameter portion includes threads for receiving the nut 172.

The third housing member 50 has a cylindrical recess 148, a ledge 152, and another cylindrical recess 150. The cylindrical recess 148 receives the bearing 156 and the other cylindrical recess 150 receives the bearing 158. The ledge 152 provides separation, support, and a seat for the bearings (156, 158). Optionally, a seal 160 is mounted in the cylindrical recess 148. Alternatively, a seal may be provided in other locations of the assembly. An outwardly extending flange 154 includes a plurality of spaced openings to receive fasteners 86. The third drive 40 is mounted in an opening in the back member 276 and secured by the fasteners 86. Optionally, a seal ("O" ring or gasket) is provided to seal the third drive 40 with the central housing 31.

In a preferred embodiment, a mount 44 on the third bevel gear 60 receives the propeller hub 64. The mount 44 includes a toothed spline on an end of the third bevel gear 60 and a complimentary toothed spline on an inner surface of a central axial opening on the first propeller hub member 162. A washer 170 and the nut 172 secure the propeller hub member 162 on the third bevel gear 60. A second propeller hub member 164 fits over the first propeller hub member 162. The second propeller hub member 164 includes a central opening for passing the air propeller output drive shaft and a central hub 166. The central hub 166 centers an air propeller (not shown) on the hub 166. The air propeller and second propeller hub member 164 are secured to the first propeller hub member 162 by a plurality of fasteners 168.

In assembly, the bearing 158 is placed or pressed into the cylindrical recess 150 until it seats on a surface of the ledge 152. The other bearing 156 is placed or pressed into the cylindrical recess 148 until it seats on an opposite surface of the ledge 152. The cylindrical section of the third bevel gear 60 is placed through the openings of the bearings (158, 156) until a surface of the third bevel gear 60 contacts a surface of the bearing 158. The seal 160 is optionally placed in the cylindrical recess 148. The first propeller hub member 162 is placed over the third bevel gear 60 on the mount 44 until and end of the first propeller hub member 162 engages a surface of the bearing 156. The washer 170 and nut 172 are placed on the threaded end of the third bevel gear 60. The nut is tightened to retain the assembly with the third housing member 50. The washer 170 keeps the nut 172 tight.

Referring now to FIGS. 7, 9, 8, and 10, the gear ratio between the first drive 36 and second drive 38 is preferably 1:1. The gear ratio between the first drive 36 and the third drive 40 is preferably 1:1. Those skilled in the art will appreciate that in the alternative, the two gear ratios may be different. A first differential drive is formed by differing the gear ratios and interaction of the first drive 26, second drive 38, and third drive 40. The first differential drive causes rotation of the second drive 38 at one speed, and simultaneous rotation of the third drive 40 at a different speed providing differential speed between the pair of air propellers at the same time.

For example, the radius of the teeth 62 of the third bevel gear 60 could be different from the radius of the teeth 58 of the second bevel gear 56. The teeth 54 of the first bevel gear 52 must be wide enough to engage the teeth 54 on a first region or portion of the teeth 54, and to engage the teeth 58 on a second region or portion of the teeth 54. This provides different gear ratios between the second and third drives.

Figure 11:
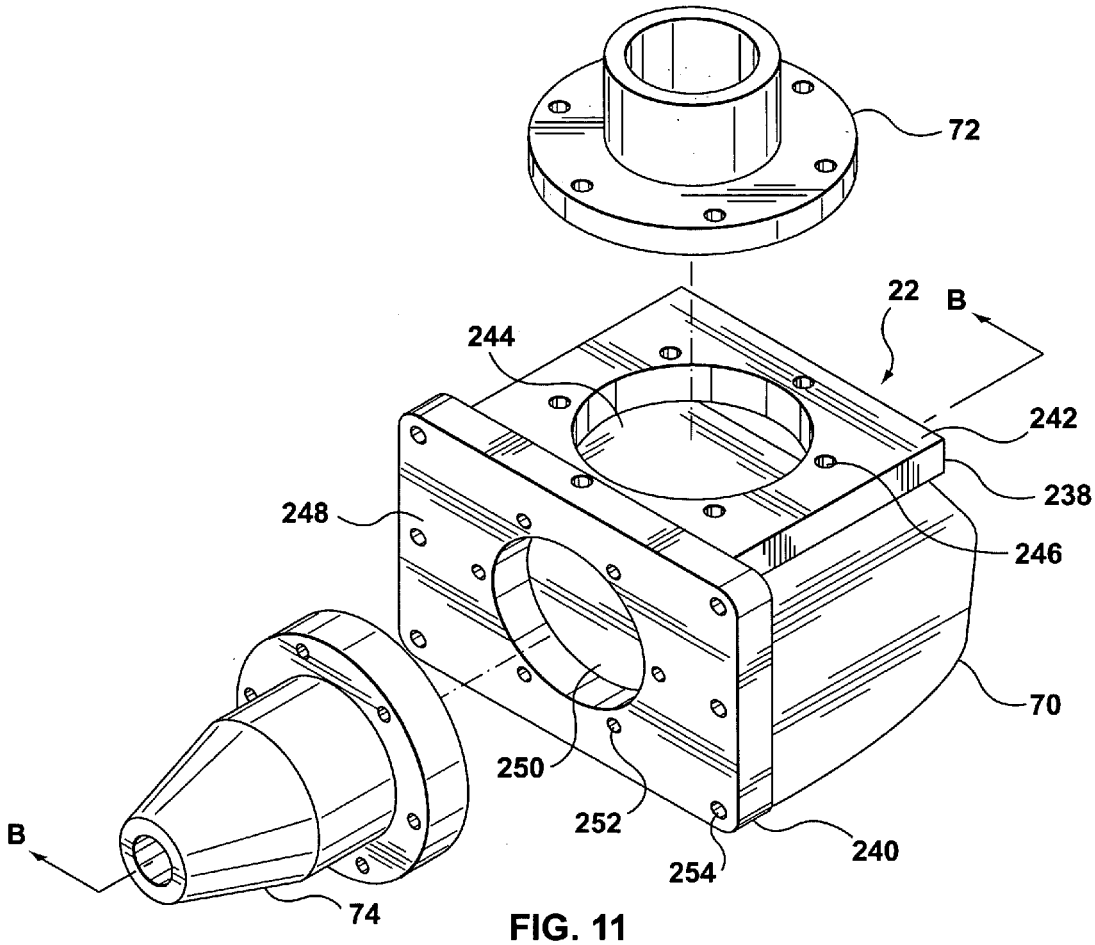
FIG. 11 is a diagrammatic perspective view of the transmission housing.

Referring now to FIG. 11, the second central housing 70 of the transmission is described. The second housing includes a top member 238. The top member 238 has a mounting surface 242 and a central opening 244. The central opening 244 and surface 242 receive for mounting the fourth drive 32 (not shown). A plurality of threaded bores 246 are provided in the top member 238 for securing and sealing the fourth housing member 72 to the top member 238 by a plurality of fasteners, for example bolts.

The second central housing 70 also includes a front member 240. The front member 240 has a mounting surface 248 and a central opening 250. The central opening 250 and surface 248 receive for mounting the fifth housing member 74. A plurality of threaded bores 252 are provided in the front member 240 for securing and sealing the fifth housing member 74 to the front member 240 by a plurality of fasteners, for example bolts. The front member 240 also includes a plurality of threaded bores 254 for mounting the second central housing 70 to the interconnecting frame 24 by a plurality of fasteners, for example bolts.

Figure 12:
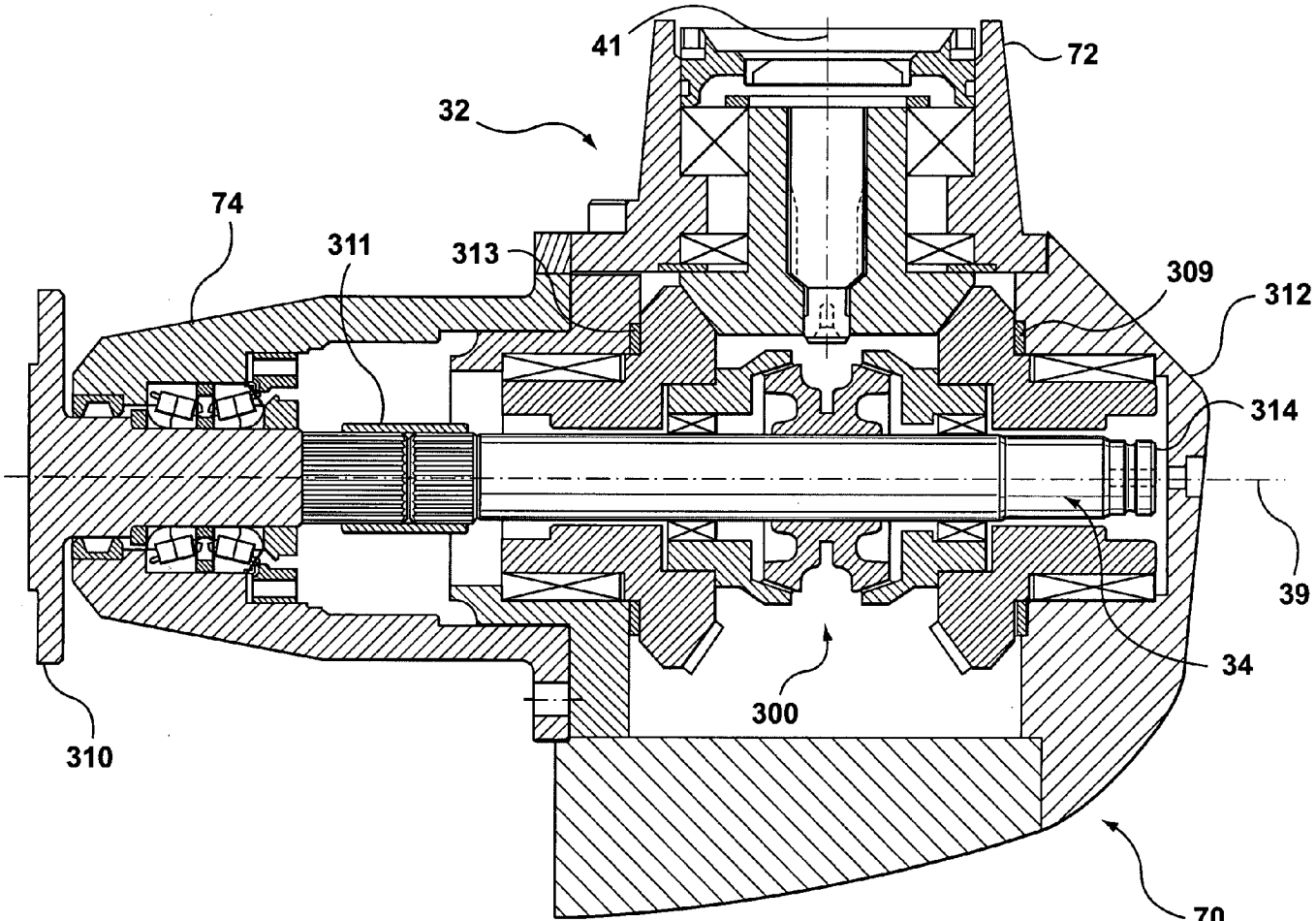
FIG. 12 is a diagrammatic cross sectional side view of the transmission illustrating the fifth drive and double cone friction clutch.

Referring now to FIG. 12, the transmission 22 is further described. The fourth drive 32 is mounted on the second central housing, generally indicated at 70. The fourth housing member 72 is secured to the second central housing 70 by a plurality of fasteners (not shown), for example bolts. The fifth drive, generally indicated at 34 is mounted in the second central housing 70. Mounted intermediate the ends of the fifth drive 34 is a double cone friction clutch, generally indicated at 300 (see FIG. 14). The fifth housing member 74 is mounted on an end of the second central housing 70 and secured by a plurality of fasteners, for example bolts (not shown). The fifth housing member 74 retains and aligns an input drive shaft 310 to the shaft 314. One end of the input drive shaft 310 is configured for mounting to an engine 14 (not shown). The other end of the input drive shaft 310 is configured for connecting to an end of the shaft 314. For example, the connection between the input drive shaft 310 and the shaft 314 is a spline to spline connection with a splined coupler 311. However, persons skilled in the art appreciate that other connections are possible, for example, through a universal joint arrangement.

In an embodiment of the invention, the second central housing 70 includes another housing member generally indicated at 312. This housing member is releasably secured by fasteners to the second central housing 70. This permits access and installation of the fifth drive 34 in the second central housing.

The input drive shaft 310 and fifth drive 34 are mounted and retained about a substantially horizontal axis 39 by the second central housing 70 and the fifth housing member 74. The fourth drive 32 is mounted and retained about a substantially vertical axis 41 by the second central housing 70. This provides operational alignment between the fourth drive 32 and the fifth drive 34.

Preferably the gear ratios between the fourth bevel gear 600, fifth bevel gear 340, and sixth bevel gear 440 are 1:1. However other gear ratios are contemplated to provide either a speed reduction, speed increase, or differential speed to the fourth bevel gear 600. A second differential drive is formed by differing the gear ratios and interaction of the fourth bevel gear 600, fifth bevel gear 340, and sixth bevel gear 440. The second differential drive causes rotation of the fourth bevel gear 600 at one speed when the clutch is in a first position, and rotation of the fourth bevel gear 600 at a different speed when the clutch is in a second position providing a different speed to the air propeller drive and air propellers for forward thrust and reverse thrust.

For example, if the gear ratio between the fourth bevel gear 600 and the fifth bevel gear 340 is different from the fourth bevel gear 600 and the sixth bevel gear 440, then the speed for reverse is different for the speed in forward because the fourth bevel gear 600 will rotate at different speeds based upon the different gear rations to the fourth bevel gear 600.

The radius of the teeth 342 of the fifth bevel gear 340 could be different, for example, larger from the radius of the teeth 442 of the sixth bevel gear 440. The teeth 602 of the fourth bevel gear 600 are wider and provide two separate areas. The first area providing a larger radius of teeth than the second area which provides a smaller radius of teeth. The teeth 342 of the fifth bevel gear 340 engage first area of the teeth 602 of the fourth bevel gear 602. The teeth 442 of the sixth bevel gear 440 engage the second area of the teeth 602 of the fourth bevel gear 602.

Figure 14:
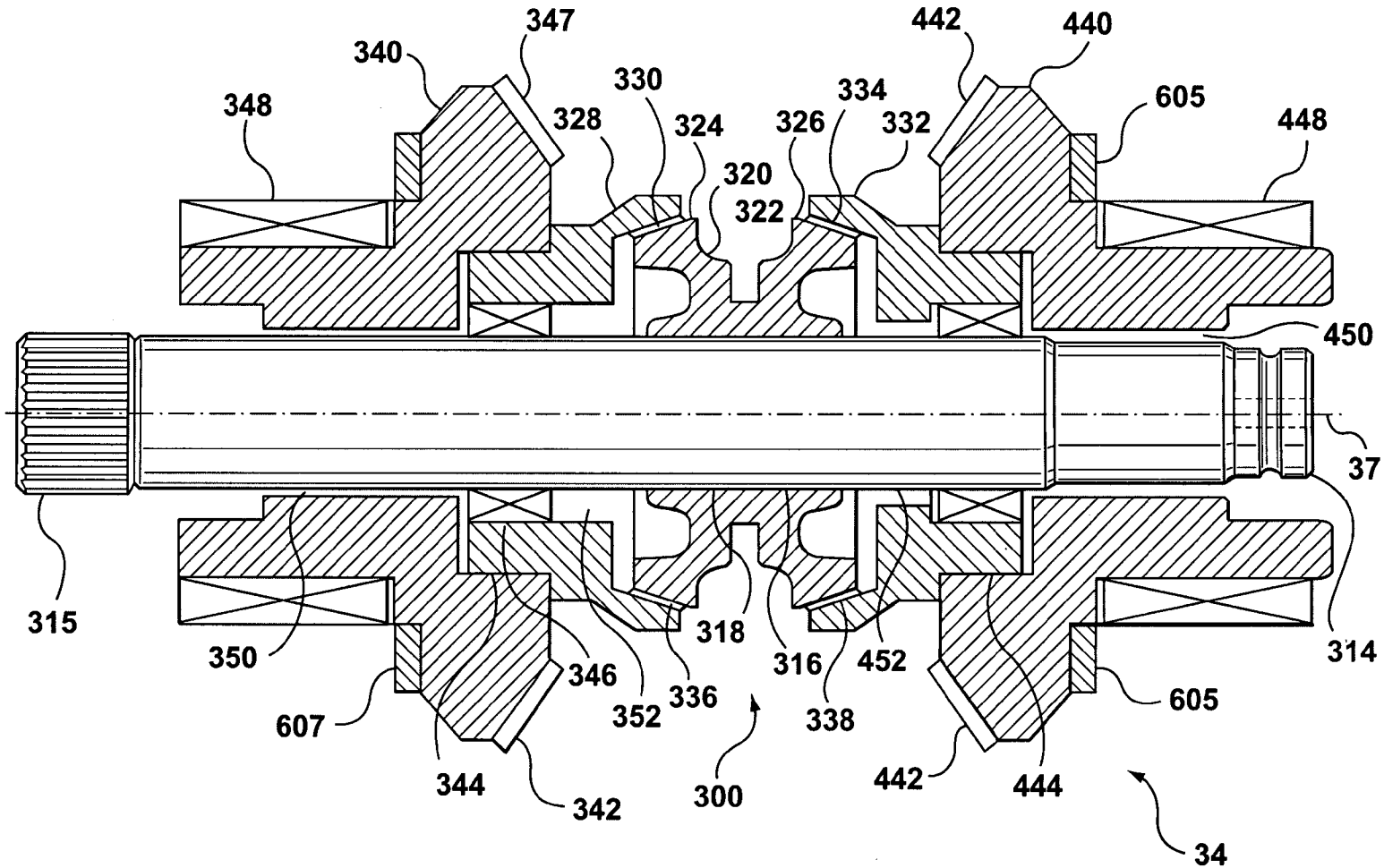
FIG. 14 is a diagrammatic cross sectional side view of the fifth drive and the double cone friction clutch.

Referring now to FIG. 14, the fifth drive generally indicated at 34 and the double cone friction clutch, generally indicated at 300, of the transmission are further described. The double cone friction clutch 300 includes a clutch member 320, first internal cone surface 330 on the first clutch coupler 328, and second internal cone surface 334 on the second clutch coupler 332. The clutch member 320 has a central splined axial bore 318. The central splined axial bore 318 is of a diameter for complimentary engagement with splines 316 intermediate the ends of the shaft 314. This splined interface between the clutch member 320 and shaft 314 permit axial movement of the clutch member 320 and rotational movement of the clutch member 320 when the shaft 314 is rotated by the engine.

The double cone friction clutch 300 also includes a first friction cone clutch 324. The first friction cone clutch 324 is formed by the first external cone surface 336 and the first internal cone surface 330 on the first clutch coupler 328.

The double cone friction clutch 300 also includes a second friction cone clutch 326. The second friction cone clutch 326 is formed by the second external cone surface 338 and the second internal cone surface 334 on the second clutch coupler 332.

The clutch member 320 includes a central annulus 322. The central annulus 322 engages a shift member (not shown) for axial movement of the clutch member 320 between a neutral position, a forward position, and a reverse position. The neutral position locates the clutch member 320 intermediate the first clutch coupler 328 and the second clutch coupler 332 such that the first external cone surface 336 does not engage the first internal cone surface 330 and the second external cone surface 338 does not engage the second internal cone surface 334. The forward position moves the clutch member 320 axially to engage the first external cone surface 336 with the first internal cone surface 330 for operating the fourth drive 32 in a first direction. The reverse position moves the clutch member 320 axially to engage the second external cone surface 338 with the second internal cone surface 334 for operating the fourth drive 32 in a second opposite direction.

Preferably, the double cone friction clutch 300 is a metal to metal clutch running in an oil bath.

The fifth drive 34 includes a fifth bevel gear 340 and the first clutch coupler 328. Teeth 342 on the fifth bevel gear 340 engage teeth 602 on the fourth bevel gear 600 (see FIGS. 12 and 15). The fifth bevel gear 340 has an axial lengthwise bore 350. The bore 350 permits the shaft 314 to extend through the fifth bevel gear 340 without engaging the gear 340. The fifth bevel gear 340 has an interface 344 for receiving the first clutch coupler 328. In an embodiment of the invention, the interface 344 is a threaded bore for complimentary engagement with threads on a cylindrical end of the first clutch coupler 342. The interface 344 provides locking engagement between the first clutch coupler 328 and the fifth bevel gear 340. The first clutch coupler 328 has an axial lengthwise bore 352. The bore 352 permits the shaft 314 to extend through the first clutch coupler 328 without engaging the coupler 328.

A bearing 346 is disposed in the bore 352 intermediate the first clutch coupler 328 and the shaft 314. A flat plate thrust bearing 607 is disposed intermediate the fifth bevel gear 340 and the second central housing 70. The flat plate thrust bearing 607 engages an underside of the fifth bevel gear 340. This prevents in operation the fifth bevel gear 340 from axially moving when the clutch member 320 engages the first clutch coupler 328. Another bearing 348 is disposed about a cylindrical surface of the fifth bevel gear 340 intermediate the fifth bevel gear 340 and the second central housing 70. The bearing 348 and bearing 346 permit rotational movement of the fifth bevel gear 340 and the first clutch coupler 328. The bearing 348, fifth bevel gear 340, first clutch coupler 328, and bearing 346 provide support for one end of the shaft 314.

Alternatively, the bearing 348, for example a roller bearing, and the flat plate thrust bearing 607 could be replaced by a two row tapered roller bearing at the same location as bearing 348. The tapered roller bearing prevents axial movement of the fifth bevel gear 340 in operation of the clutch.

The fifth drive 34 also includes a sixth bevel gear 440 and the second clutch coupler 332. Teeth 442 on the sixth bevel gear 440 engage teeth 602 on the fourth bevel gear 600 (see FIGS. 12 and 15). The sixth bevel gear 440 has an axial lengthwise bore 450. The bore 450 permits the shaft 314 to extend through the sixth bevel gear 440 without engaging the gear 440. The sixth bevel gear 440 has an interface 444 for receiving the second clutch coupler 332. In an embodiment of the invention, the interface 444 is a threaded bore for complimentary engagement with threads on a cylindrical end of the second clutch coupler 332. The interface 444 provides locking engagement between the second clutch coupler 332 and the sixth bevel gear 440. The second clutch coupler 332 has an axial lengthwise bore 452. The bore 452 permits the shaft 314 to extend through the second clutch coupler 332 without engaging the coupler 332.

A bearing 446 is disposed in the bore 452 intermediate the second clutch coupler 332 and the shaft 314. A second flat plate thrust bearing 607 is disposed intermediate the sixth bevel gear 440 and the second central housing 70. The second flat plate thrust bearing 607 engages an underside of the sixth bevel gear 440. This prevents in operation the sixth bevel gear 440 from moving axially when the clutch member 320 engages the second clutch coupler 332. Another bearing 448 is disposed about a cylindrical surface of the sixth bevel gear 440 intermediate the sixth bevel gear 440 and the second central housing 70. The bearing 448 and bearing 446 permit rotational movement of the sixth bevel gear 440 and the second clutch coupler 332. The bearing 448, sixth bevel gear 440, second clutch coupler 332, and bearing 446 provide support for a second end of the shaft 314.

Alternatively, the bearing 448, for example a roller bearing, and the second flat plate thrust bearing 605 could be replaced by a two row tapered roller bearing at the same location as bearing 448. The tapered roller bearing prevents axial movement of the sixth bevel gear 440 in operation of the clutch.

The shaft 314 includes splines 315 on one end of the shaft 314 for engagement with a coupler 311 and connection to the input drive shaft 310 (see FIG. 12).

Figure 13:
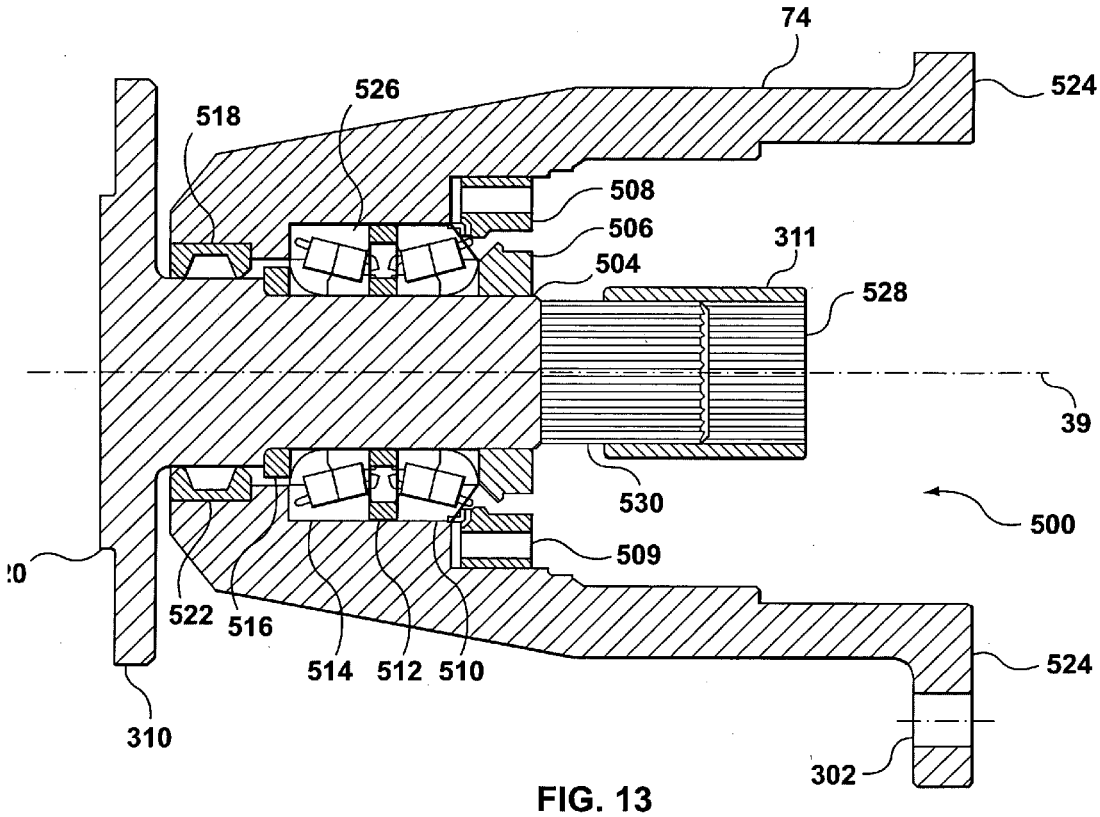
FIG. 13 is a diagrammatic cross sectional side view of the fifth housing member illustrating the connection between the engine and transmission.

Referring now to FIG. 13, the fifth housing 74 and input drive assembly are further described. The fifth housing 74 is generally hollow as indicated at 500. The fifth housing 74 is mounted to an end of the second central housing 70 by a mounting surface 524 and plurality of openings 502 that receive fasteners, for example bolts to tightly seal and secure the fifth housing 74 to a complimentary mounting surface 248 of the second central housing 70. A bore 522 is provided in an end of the fifth housing 74 for receiving the input drive shaft 310. A seal 518 is mounted in the bore 522 to keep a lubricating fluid, for example oil, within the transmission.

The input drive shaft 310 has an engine mount 520 on one end to engage the engine 14 (not shown) for rotational movement of the drive shaft 310. The input drive shaft 310 is substantially cylindrical. The other end of the input drive shaft is splined 530 to cooperate with a splined coupler 311 for connection to the splined end of the shaft 314 (see FIG. 14). The splined coupler 311 includes an internal splined surface 528. A first spacer 516, bearing 514, second spacer 512, and another bearing 510 are mounted over the input drive shaft 310. Intermediate the ends of the input drive shaft 310 is a threaded portion 504 to receive a nut 506. The first spacer 516 and nut 506 keep the bearings 514, 510 and input drive shaft 310 in operational alignment. A cylindrical bore 526 and ledge formed in the fifth housing 74 receive the bearings (514, 510). A nut 508 keeps the bearings in tight engagement with the fifth housing 74 and keeps the input drive shaft 310 in axial alignment with the shaft 314 located in the second central housing 70.

Preferably, the bearings 510, 514 are tapered roller bearings to prevent axial movement of the input drive shaft 310 in operation.

Figure 15:
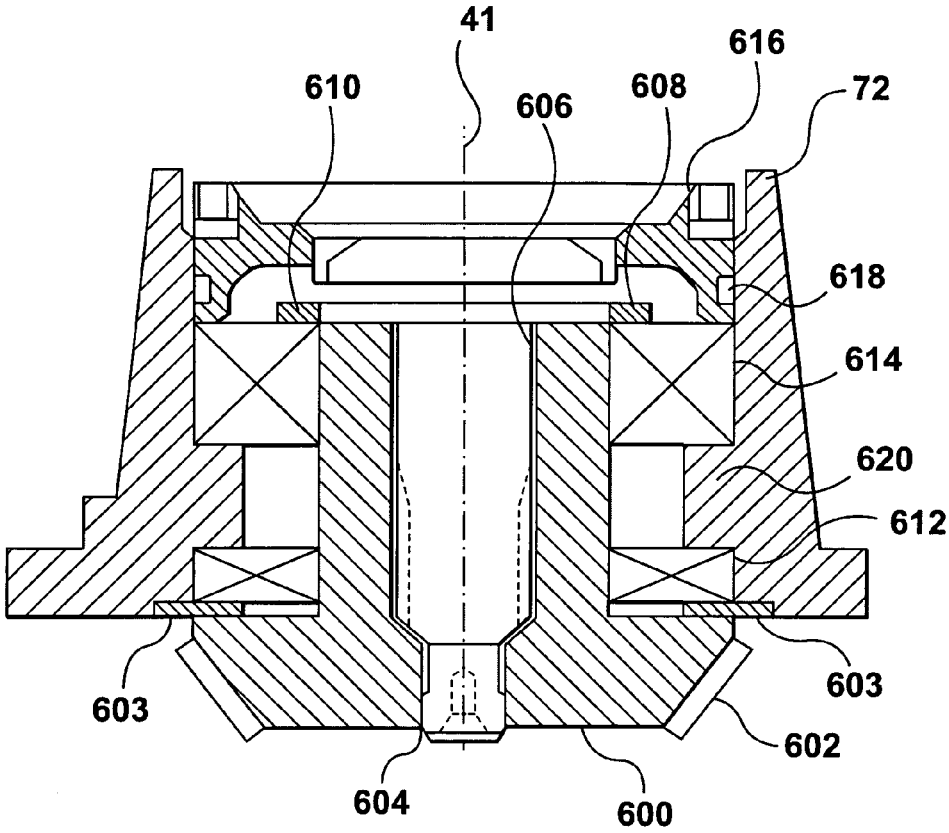
FIG. 15 is a diagrammatic cross sectional side view of the fourth drive.

Referring now to FIG. 15, the fourth drive of the transmission is further described. The fourth drive housing 72 has a cylindrical axial opening. An outwardly extending ledge 620 of the housing 72 extends into the cylindrical axial opening. A bearing 612 is located in a cylindrical recess and the bearing engages one side of the ledge 620. A second bearing 614 is located in another cylindrical recess and the bearing engages a opposite side of the ledge 620. A third flat plate thrust bearing 603 is disposed intermediate the fourth bevel gear 600 and the housing 72. The third flat plate thrust bearing 605 engages an underside of the fourth bevel gear 600. This prevents in operation the fourth bevel gear 600 from moving axially in operation. The fourth bevel gear 600 has a cylindrical section that engages both the first bearing 612 and the second bearing 614. One end of the cylindrical section is threaded 608 to receive a nut 610. The fourth bevel gear 600 and nut 610 cooperate to keep the bearing 614 and bearing 612 in place within the housing 72. The fourth bevel gear 600 is rotatable about a vertical axis. The fourth bevel gear 600 includes an axial bore. The axial bore has a centering section 604 for receiving an end of the interconnecting drive shaft (not shown) and a larger diameter splined section 606. The splined section 606 cooperates with a splined section of the interconnecting drive shaft to rotate the interconnecting drive shaft upon rotation of the fourth bevel gear 600. A bearing retainer cap 616 and seal 618 are provided in an end of the housing 72.

Alternatively, the bearings 614 and 612, for example a roller bearings, and the third flat plate thrust bearing 603 could be replaced by a two row tapered roller bearing. The tapered roller bearing prevents axial movement of the fourth bevel gear 600 in operation.

Referring now to FIG. 4, the interconnecting frame 24 is described. The interconnecting frame 24 includes an engine mount 222 for securing the interconnecting frame 24 to the back of the engine. Another hull frame mount 226 is provided to secure the interconnecting frame 24 to an inside surface of the hull 12 of the airboat. A transom frame mount 228 is provided to secure the interconnecting frame 24 to the transom of the airboat 10.

The interconnecting frame 24 has a number of upright members 230 connected to a number of horizontal members 232 that form a substantially rectangular box like structure. The box like structure is further strengthened by a number of diagonal members 234. The interconnecting frame 24 may be welded together, or fastened together with fasteners such as nuts and bolts. Alternatively, the interconnecting frame 24 could be a cast or an enclosed structure. Alternatively, the interconnecting frame 24 could be part of the air propeller cage (not shown). The interconnecting frame 24 has a central vertical opening for receiving the interconnecting drive shaft 30 between the transmission 22 and the air propeller drive 26.

The interconnecting frame 24 has a transmission mount 224 located at one end of the frame and a air propeller drive mount 236 located at another end of the frame. The transmission mount 224 and the air propeller drive mount 236 are located in the interconnecting frame 24 such that the first drive 36 and the fourth drive 32 are in alignment when connected by the interconnecting drive shaft 30. The transmission 22 is secured to the transmission mount 224 by fasteners and the air propeller drive 26 is also secured to the air propeller drive mount 236 by fasteners. In the preferred embodiment, the transmission 22 is mounted to the interconnecting frame 24. Alternatively, the transmission 22 may be mounted to an inside surface of the hull 12 of the airboat 10.

Referring now to FIGS. 7 and 12, assembly of the drive system is described. The air propeller drive 26 is assembled as a unit. The first drive 36, second drive 38 and third drive 40 are assembled and installed into the central housing 31 of the counter rotating air propeller drive 26. The central housing 31 is then filled to a predetermined level with a lubricating fluid.

The transmission 22 is also assembled as a unit. The fourth drive 32, fifth drive 34, and double cone friction clutch 300 are assembled and installed into the second central housing 70. The input drive shaft 310 and fifth drive housing 74 are assembled and installed to the second central housing 70. The second central housing 70 is then filled to a predetermined level with a lubricating fluid.

For the embodiment illustrated in FIG. 1 where the engine 14 is mounted high in the hull 12 of the airboat 10, the transmission 22 and air propeller drive 26 may be secured together by a plurality of fasteners and connected by a short interconnecting drive shaft 30 (see FIG. 3).

For the embodiment illustrated in FIG. 2 where the engine 14 is mounted low in the hull 12 of the airboat 10, the transmission 22 and air propeller drive 26 are secured to the interconnecting frame 24 by a plurality of fasteners and connected by a longer interconnecting drive shaft 30 (see FIG. 4).

Referring now to FIGS. 7 and 12, operation of the selectable drive is further described. The engine 14 of the airboat 10 rotates the input drive shaft 310 which through the splined connection, rotates the shaft 34. The shaft 34 rotates the clutch member 320. With the double cone friction 300 in the neutral position, the fifth bevel gear 342 and the sixth bevel gear 442 do not rotate. Therefore, the fourth bevel gear 600, interconnecting drive shaft 30, third bevel gear 40, second bevel gear 38, and first bevel gear 36 do not rotate and the air propellers remain stationary.

When the double cone friction clutch 300 is placed into a first position, for example forward, the rotating shaft 314 and double cone friction clutch 300 rotate the fifth bevel gear 342, but not the sixth bevel gear 440. This rotates the fourth bevel gear 600, interconnecting drive shaft 30 and third bevel gear 40. The third bevel gear 40 rotates the second bevel gear 38 in a first direction and the first bevel gear 36 in a second opposite direction. The air propellers counter rotate in a direction that provides forward thrust to the airboat 10.

When the double cone friction clutch 300 is placed into a second position, for example reverse, the rotating shaft 314 and clutch 300 rotate the sixth bevel gear 440, but not the fifth bevel gear 342. This rotates the fourth bevel gear 600, interconnecting drive shaft 30, and third bevel gear 40 in an opposite direction. The third bevel gear 40 rotates the second bevel gear 38 in an opposite first direction and the first bevel gear 36 in an opposite second direction. The air propellers counter rotate in a direction that provides reverse thrust to the airboat 10.

It will, of course, be understood that the above description has been given by way of example only and that modifications in detail may be made within the scope of the present invention.

Nomenclature for the Figures:

10—airboat
12—hull
14—engine
16—drive system
18—pair of air propellers
20—air rudders
22—transmission
24—interconnecting frame
26—counter rotating air propeller drive
30—interconnecting drive shaft
31—central housing
32—fourth drive
34—fifth drive
36—first drive
37—first horizontal axis
38—second drive
39—second horizontal axis
40—third drive
41—vertical axis
42—air propeller output drive shaft
44—air propeller mount
46—first housing member
48—second housing member
50—third housing member
52—first bevel gear
54—teeth
56—second bevel gear
58—teeth
60—third bevel gear
62—teeth
64—air propeller hub
66—mount
68—second air propeller hub
70—second central housing
72—fourth housing member
74—fifth housing member
82—second bearing
84—bearing
86—fastener
88—lock washer
90—nut
92—retainer
94—mount

96—cylindrical recess
98—second cylindrical recess
100—flange
102—ledge
104—third cylindrical recess
106—retainer
108—second bearing
110—bearing
112—flange
114—first cylindrical recess
116—second cylindrical recess
118—ledge
120—third cylindrical recess
122—mount
124—retainer
126—nut
128—lock washer
130—retainer
132—bearing
134—flange
136—bolts
138—central hub
140—lock washer
142—nut
144—threaded end
146—central axial opening
148—cylindrical recess
150—cylindrical recess
152—ledge
154—flange
156—bearing
158—bearing
160—seal
162—first propeller hub member
164—second propeller hub member
166—central hub
168—fastener
170—washer
172—nut
184—mount
222—engine mount member
224—transmission mount
226—hull frame mount
228—transom frame mount
230—upright members
232—horizontal members
234—diagonal members
236—air propeller drive mount
238—top member
240—front member
242—mounting surface
244—central opening
246—threaded bores
248—mounting surface
250—central opening
252—threaded bores
254—threaded bores
256—frame member
258—bores
260—bottom member
262—central opening
264—mounting surface
266—threaded bores
268—front member
270—central opening
272—mounting surface
274—threaded bores
276—back member
278—primary drive section
280—secondary universal joint
282—primary universal joint
284—sliding joint
286—secondary drive section
288—secondary drive interconnect
290—primary drive interconnect
300—double cone friction clutch
310—input drive shaft
311—spline coupler
312—housing member
314—shaft
315—spline
316—spline
318—central splined axial bore
320—clutch member
322—annulus
324—first friction cone clutch
326—second friction cone clutch
328—first clutch coupler
330—first internal cone surface
332—second clutch coupler
334—second internal cone surface
336—first external cone surface
338—second external cone surface
340—fifth bevel gear
342—teeth
344—interface
346—bearing
348—bearing
350—axial bore
352—axial bore
440—sixth bevel gear
442—teeth
444—interface
446—bearing
448—bearing
450—axial bore
452—axial bore
500—hollow opening
502—opening
504—threaded portion
506—nut
508—nut
510—bearing
512—second spacer
514—bearing
516—spacer
518—seal
520—engine mount
522—bore
524—mounting surface
526—bore
528—internal spline surface
530—spline
600—fourth bevel gear
602—teeth
603—third flat plate thrust bearing
604—centering section
605—first flat plate thrust bearing
606—splined bore
607—second flat plate thrust bearing
608—threads
610—nut
612—bearing
614—second bearing

616—bearing retainer cap
618—seal
620—ledge

What is claimed is:

1. An airboat comprising:
a hull;
an engine mounted in said hull;
at least one air rudder;
at least one air propeller;
a selectable drive system;
said selectable drive system including:
an air propeller drive;
a transmission; and
a clutch;
said engine being configured to engage said transmission to provide operational power to said transmission,
said transmission being configured to provide the operational power to said air propeller drive,
said at least one air propeller being rotated by said air propeller drive,
said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second opposite direction for moving said airboat in a reverse direction.

2. An airboat as in claim 1 further including:
a first differential drive,
said first differential drive being configured to provide a first differential rotational speed to a first air propeller and a second differential rotational speed to a second air propeller in a second opposite direction.

3. An airboat comprising:
a hull;
an engine mounted in said hull;
at least one air rudder;
at least one air propeller;
a selectable drive system;
said selectable drive system including:
an air propeller drive;
a transmission; and
a clutch;
said engine being configured to engage said transmission to provide operational power to said transmission,
said transmission being configured to provide the operational power to said air propeller drive,
said at least one air propeller being configured to be rotated by said air propeller drive,
said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second opposite direction for moving said airboat in a reverse direction,
a second differential drive,
said second differential drive being configured to provide a reverse rotational speed to a first air propeller when said clutch is in said reverse position, and said first differential drive being configured to provide a different forward rotational speed to a second air propeller when said clutch is in said forward position.

4. An airboat comprising:
a hull;
an engine mounted in said hull;
at least one air rudder;
at least one air propeller;
a selectable drive system;
said selectable drive system including:
an air propeller drive;
a transmission; and
a clutch;
said engine being configured to engage said transmission to provide operational power to said transmission,
said transmission being configured to provide the operational power to said air propeller drive,
said at least one air propeller being configured to be rotated by said air propeller drive,
said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second opposite direction for moving said airboat in a reverse direction,
wherein said air propeller drive comprises a counter rotating air propeller drive configured for simultaneous counter rotation of a first air propeller in a first direction and a second air propeller in a second, opposite direction.

5. An airboat as in claim 4 wherein said counter rotating air propeller drive includes:
a first drive,
a second drive, and
a third drive,
said first air propeller being configured to be rotated by said second drive,
said second air propeller being configured to be rotated by said third drive,
said first drive being configured to (i) rotate said second drive in a first direction and (ii) said third drive in an opposite, second direction.

6. An airboat as in claim 5 wherein: said second drive extends through said third drive.

7. An airboat as in claim 5 wherein said first drive includes:
a first bevel gear and
a first housing member,
said first bevel gear mounted in said first housing,
said first bevel gear being configured to be rotated by transmission members.

8. An airboat as in claim 7 wherein said second drive includes:
a second bevel gear,
a second housing member, and
an air propeller drive shaft,
said second bevel gear being mounted in said second housing,
said second bevel gear having a mount configured to receive an air propeller drive shaft,
said second air propeller being configured to be rotated by said air propeller drive shaft,
teeth on said second bevel gear engaging teeth on said first bevel gear for rotation of said second bevel gear by said first bevel gear, and said second housing mounted in said counter rotating air propeller drive about a horizontal axis.

9. An airboat as in claim 8 wherein said third drive includes:

a third bevel gear, and a third housing member, said third bevel gear mounted in said third housing member, said third bevel gear being configured for rotating said first air propeller, teeth on said third bevel gear engaging teeth on said first bevel gear for rotation of said third bevel gear by said first bevel gear, and said third housing mounted in said counter rotating air propeller drive about said horizontal axis.

10. An airboat as in claim 4 wherein said transmission includes:

a fourth drive, and a fifth drive, said fifth drive configured to rotate said fourth drive.

11. An airboat as in claim 5 wherein said transmission includes:

a fourth drive, and a fifth drive, said fifth drive configured to rotate said fourth drive, and said fourth drive configured to rotate said first drive.

12. An airboat as in claim 11 wherein said fourth drive includes:

a fourth bevel gear, and a fourth housing member, said fourth bevel gear mounted in said fourth housing member, said fourth bevel gear and said first bevel gear connected by an interconnecting drive shaft.

13. An airboat as in claim 12 wherein said fifth drive includes:

a fifth bevel gear, and a sixth bevel gear, said fifth bevel gear configured to rotate said fourth bevel gear in a first direction when said clutch is in said forward position, and said sixth bevel gear configured to rotate said fourth bevel gear in a second, opposite direction when said clutch is in said reverse position.

14. An airboat as in claim 13 wherein:

teeth on said fifth bevel gear being configured to engage teeth on said fourth bevel gear, and teeth on said sixth bevel gear being configured to engage said teeth on said fourth bevel gear.

15. An airboat comprising:

a hull;

an engine mounted in said hull;

at least one air rudder;

at least one air propeller;

a selectable drive system;

said selectable drive system including:

an air propeller drive;

a transmission; and a clutch;

said engine being configured to engage said transmission to provide operational power to said transmission, said transmission being configured to provide the operational power to said air propeller drive, said at least one air propeller being configured to be rotated by said air propeller drive, said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second opposite direction for moving said airboat in a reverse direction, a first friction cone clutch, said first friction cone clutch having a neutral position and an engaging position configured to provide said operational power to said air propeller drive in a first forward direction.

16. An airboat as in claim 15 further including:

a second friction cone clutch, said second friction cone clutch having a neutral position and an engaging position configured to provide said operational power to said air propeller drive in a second reverse direction.

17. An airboat as in claim 16 further including:

a fourth bevel gear, a fifth bevel gear, a sixth bevel gear, and a clutch member, said fourth bevel gear configured to provide said operational power to said air propeller drive, said fifth bevel gear engaging said fourth bevel gear, said sixth bevel gear engaging said fourth bevel gear, said first friction cone clutch intermediate a driven shaft and said fifth bevel gear, and said second friction cone clutch intermediate said driven shaft and said sixth bevel gear.

18. An airboat as in claim 17 further including:

a first clutch coupler, and a second clutch coupler, said first clutch coupler intermediate said fifth bevel gear and said clutch member, and said second clutch coupler intermediate said sixth bevel gear and said clutch member.

19. An airboat as in claim 18 wherein:

said first friction cone clutch comprises (i) a first external cone surface on said clutch member and (ii) a first internal cone surface on said first clutch coupler, and wherein said second friction cone clutch comprises (i) a second external cone surface on said clutch member and (ii) a second internal cone surface on said second clutch coupler.

20. A selectable drive system for an airboat comprising:

an air propeller drive;

a transmission; and a clutch;

said transmission having an interface configured for connection to an airboat engine, said transmission configured to provide operational power to said air propeller drive, said air propeller drive being configured to rotate at least one air propeller, said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second, opposite direction for moving said airboat in a reverse direction.

21. A selectable drive system for an airboat as in claim 20 further including:

a first differential drive, said first differential drive being configured to provide a first differential rotational speed to a first air propeller and a second differential rotational speed to a second air propeller in a second opposite direction.

22. A selectable drive system for an airboat comprising:

an air propeller drive;

a transmission; and a clutch;

said transmission having an interface configured for connection to an airboat engine, said transmission configured to provide operational power to said air propeller drive, said air propeller drive being configured to rotate at least one air propeller, said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second, opposite direction for moving said airboat in a reverse direction, a second differential drive configured to provide a reverse rotational speed to a first air propeller when said clutch is in said reverse position, and said first differential drive configured to provide a different forward rotational speed to a second air propeller when said clutch is in said forward position.

23. A selectable drive system for an airboat comprising:

an air propeller drive;

a transmission; and a clutch;

said transmission having an interface configured for connection to an airboat engine, said transmission configured to provide operational power to said air propeller drive, said air propeller drive being configured to rotate at least one air propeller, said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second, opposite direction for moving said airboat in a reverse direction, said air propeller drive comprising a counter rotating air propeller drive for simultaneous counter rotation of a first air propeller in a first direction and a second air propeller in a second, opposite direction.

24. A selectable drive system for an airboat as in claim 23 wherein said counter rotating air propeller drive includes:

a first drive, a second drive, and a third drive, said first air propeller being configured to be rotated by said second drive, said second air propeller being configured to be rotated by said third drive, said first drive being configured to (i) rotate said second drive in a first direction and (ii) said third drive in an opposite, second direction.

25. A selectable drive system for an airboat as in claim 24 wherein:

said second drive extends through said third drive.

26. A selectable drive system for an airboat as in claim 24 wherein said first drive includes:

a first bevel gear, and a first housing member, said first bevel gear being mounted in said first housing, said first bevel gear being configured to be rotated by transmission members.

27. A selectable drive system for an airboat as in claim 26 wherein said second drive includes:

a second bevel gear, a second housing member, and an air propeller drive shaft, said second bevel gear being mounted in said second housing, said second bevel gear having a mount configured to receive an air propeller drive shaft, said second air propeller being configured to be rotated by said air propeller drive shaft, teeth on said second bevel gear being configured to engage teeth on said first bevel gear for rotation of said second bevel gear by said first bevel gar, and said second housing being configured to be mounted in said counter rotating air propeller drive about a horizontal axis.

28. A selectable drive system for an airboat as in claim 27 wherein said third drive includes:

a third bevel gear, a third housing member, and an air propeller mount, said third bevel gear breing mounted in said third housing member, said third bevel gear being configured to rotate said first air propeller, teeth on said third bevel gear being configured to engage teeth on said first bevel gear for rotation of said third bevel gear by said first bevel gear, and said third housing being configured to be mounted in said counter rotating air propeller drive about said horizontal axis.

29. A selectable drive system for an airboat as in claim 23 wherein said transmission includes:

a fourth drive, and a fifth drive, said fifth drive being configured to rotate said fourth drive.

30. A selectable drive system for an airboat as in claim 24 wherein said transmission includes:

a fourth drive, and a fifth drive, said fifth drive being configured to rotate said fourth drive, and said fourth drive being configured to rotate said first drive.

31. A selectable drive system for an airboat as in claim 30 wherein said fourth drive includes:

a fourth bevel gear, and a fourth housing member, said fourth bevel gear being mounted in said fourth housing member, said fourth bevel gear and said first bevel gear being connected by an interconnecting drive shaft.

32. A selectable drive system for an airboat as in claim 31 wherein said fifth drive includes:

a fifth bevel gear, and a sixth bevel gear, said fifth bevel gear being configured to rotate said fourth bevel gear in a first direction when said clutch is in said forward position, and said sixth bevel gear being configured to rotate for said fourth bevel gear in a second, opposite direction when said clutch is in said reverse position.

33. A selectable drive system for an airboat as in claim 32 wherein:

teeth on said fifth bevel gear engage teeth on said fourth bevel gear, and teeth on said sixth bevel gear engage said teeth on said fourth bevel gear.

34. A selectable drive system for an airboat comprising:

an air propeller drive;

a transmission;

a clutch;

said transmission having an interface configured for connection to an airboat engine, said transmission configured to provide operational power to said air propeller drive, said air propeller drive being configured to rotate at least one air propeller, said clutch being configured to be operable between a forward position and a reverse position, said clutch in said forward position directs rotation of said at least one air propeller in a first direction for moving said airboat in a forward direction, and said clutch in said reverse position directs rotation of said at least one air propeller in a second, opposite direction for moving said airboat in a reverse direction, a first friction cone clutch, said first friction cone clutch having a neutral position and an engaging position configured to provide said operational power to said air propeller drive in a first forward direction.

35. A selectable drive system for an airboat as in claim 34 further including:

a second friction cone clutch, said second friction cone clutch having a neutral position and an engaging position configured to provide said operational power to said air propeller drive in a second, reverse direction.

36. A selectable drive system for an airboat as in claim 35 further including:

a fourth bevel gear, a fifth bevel gear, a sixth bevel gear, and a clutch member, said fourth bevel gear being configured to provide said operational power to said air propeller drive, said fifth bevel gear being configured to engage engaging said fourth bevel gear, said sixth bevel gear being configured to engage engaging said fourth bevel gear, said first friction cone clutch intermediate a driven shaft and said fifth bevel gear, and said second friction cone clutch intermediate said driven shaft and said sixth bevel gear.

37. A selectable drive system for an airboat as in claim 36 further including:

a first clutch coupler, and a second clutch coupler, said first clutch coupler intermediate said fifth bevel gear and said clutch member, and said second clutch coupler intermediate said sixth bevel gear and said clutch member.

38. A selectable drive system for an airboat as in claim 37 wherein:

said first friction cone clutch comprises (i) a first external cone surface on said clutch member and (ii) a fist internal cone surface on said first clutch coupler, and wherein said second friction cone clutch comprises (i) a second external cone surface on said clutch member and (ii) a second internal cone surface on said second clutch coupler.

* * * * *